US010138583B2

(12) United States Patent
Harada et al.

(10) Patent No.: US 10,138,583 B2
(45) Date of Patent: Nov. 27, 2018

(54) CLOTH CLAMPING DEVICE

(71) Applicant: BROTHER KOGYO KABUSHIKI KAISHA, Nagoya-shi, Aichi-ken (JP)

(72) Inventors: Koichi Harada, Komaki (JP); Yuji Tagawa, Nagoya (JP); Hiroki Yamaura, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 63 days.

(21) Appl. No.: 15/465,178

(22) Filed: Mar. 21, 2017

(65) Prior Publication Data

US 2017/0275798 A1 Sep. 28, 2017

(30) Foreign Application Priority Data

Mar. 23, 2016 (JP) ..... 2016-058294

(51) Int. Cl.

| | |
|---|---|
| ***D05B 27/00*** | (2006.01) |
| ***D05B 33/02*** | (2006.01) |
| ***D05B 33/00*** | (2006.01) |
| ***B65H 3/00*** | (2006.01) |

(52) U.S. Cl.

CPC ..... *D05B 33/02* (2013.01); *B65H 3/00* (2013.01); *D05B 33/006* (2013.01)

(58) Field of Classification Search

CPC ..... D05B 33/00; D05B 33/006; D05B 33/02; D05B 35/00; D05B 39/00; B65H 3/00

USPC ..... 112/303, 311

See application file for complete search history.

(56) References Cited

U.S. PATENT DOCUMENTS 5,845,759 A 12/1998 Takada et al.
6,123,038 A * 9/2000 Kames ..... D05B 11/00 112/117

FOREIGN PATENT DOCUMENTS

| | | | |
|---|---|---|---|
| EP | 0582130 | A2 | 2/1994 |
| JP | H01 91895 | A | 4/1989 |
| JP | H04 303494 | A | 10/1992 |
| JP | H06 329288 | A | 11/1994 |
| JP | 2000-288278 | A | 10/2000 |

OTHER PUBLICATIONS

Extended European Search Report (EESR) dated Oct. 2, 2017 in corresponding EP Application No. 17162159.2.

* cited by examiner

*Primary Examiner* — Nathan Durham

(74) *Attorney, Agent, or Firm* — K&L Gates LLP

(57) ABSTRACT

A cloth clamping device includes a clamping mechanism that comes into contact with a cloth and an up-and-down movement mechanism that moves the clamping mechanism up and down. The clamping mechanism includes a support portion, a leg portion, a foot portion, and a clamping portion. The clamping portion has a leading end portion facing the foot portion in a sideway direction and a base end portion being pivotally supported by the support portion. When the leg portion is lowered with respect to the support portion, the leading end portion pivots downward and is positioned in a sideway direction with respect to the foot portion, and when the leg portion is raised with respect to the support portion, the clamping portion comes into contact with the upper surface of the cloth and the leading end portion is positioned above the foot portion, and the clamping mechanism draw up the cloth.

10 Claims, 31 Drawing Sheets

CLOTH CLAMPING DEVICE

CROSS-REFERENCE TO RELATED APPLICATION

This application claims priority to Japanese Patent Application No. 2016-058294, filed on Mar. 23, 2016, the content of which is hereby incorporated by reference.

BACKGROUND

The present disclosure relates to a cloth clamping device that grips a cloth.

When sewing by a sewing machine is automated, a device is needed that removes a single cloth from among a plurality of cloths stacked on top of each other, and feeds the cloth to the sewing machine. For example, a fabric moving device is known in which an air cylinder is fixed to a leading end of a pivoting arm, via an arm. A rod of the air cylinder moves up and down, and an object to be sewn gripping portion is connected below the rod. The object to be sewn gripping portion has two openable/closeable contact members. When moving the cloth, the fabric moving device operates the air cylinder and lowers the object to be sewn gripping portion. The leading ends of the contact members thus come into contact with the cloth. A drive mechanism closes the contact members and the cloth can thus be gripped.

SUMMARY

The two contact members are rod shaped, and are provided with a point of support in a portion above the leading ends. The contact members open and close by the leading ends being caused to come close each other or move away from each other. After the leading ends come into contact with the cloth and grip the cloth by the leading ends coming close to each other, it is necessary for the object to be sewn gripping portion to move the point of support upward. Thus, it is necessary for the fabric moving device to be provided, on the object to be sewn gripping portion, with a mechanism to open and close the contact members and a mechanism to move the point of support up and down, thus making the configuration complex. The contact members move relatively upward due to the movement of the point of support, while moving downward along with the object to be sewn gripping portion, and thus, a force pressing the cloth downward becomes unstable. As a result, it is possible that the contact members may lose their grip on the cloth due to insufficient pressing force, or may grip a plurality of the cloths due to an excessive pressing force.

It is an object of the present disclosure to provide a cloth clamping device that can reliably separate and clamp a single cloth, while having a simple configuration.

A cloth clamping device of the present disclosure includes a clamping mechanism and an up-and-down movement mechanism. The clamping mechanism is configured to come into contact with an upper surface of a cloth, among cloths placed so as to be stacked in the up-down direction, and to clamp the cloth with which the contact is made. The clamping mechanism includes a support portion, a leg portion, a foot portion, and a clamping portion. The leg portion is provided on the support portion such that a lower end of the leg portion protrudes below the support portion, and such that the leg portion is capable of moving up and down between an upper position in which the leg portion is positioned relatively upward with respect to the support portion, and a lower position in which the leg portion is positioned relatively downward with respect to the support portion. The foot portion is provided on the lower end of the leg portion and protrudes in a sideway direction from the leg portion. The foot portion comes into contact with the upper surface of the cloth when the leg portion is positioned in the upper position. The clamping portion includes a leading end portion and a base end portion. The leading end portion faces the foot portion in the sideway direction. The base end portion is pivotally supported by the support portion, at a position in the sideway direction with respect to the leading end portion and above the leading end portion. The clamping portion is positioned in a closed position when the leg portion is in the upper position and is positioned in an open position when the leg portion is in the lower position. The closed position is a position in which the clamping portion comes into contact with the upper surface of the cloth and the leading end portion is positioned above the foot portion. The open position is a position in which the leading end portion pivots downward with respect to the closed position and is positioned in a sideway direction with respect to the foot portion. The up-and-down movement mechanism is configured to move the clamping mechanism up and down. The up-and-down movement mechanism is connected to the support portion.

BRIEF DESCRIPTION OF THE DRAWINGS

Embodiments will be described below in detail with reference to the accompanying drawings in which.

DETAILED DESCRIPTION

Figure 1:
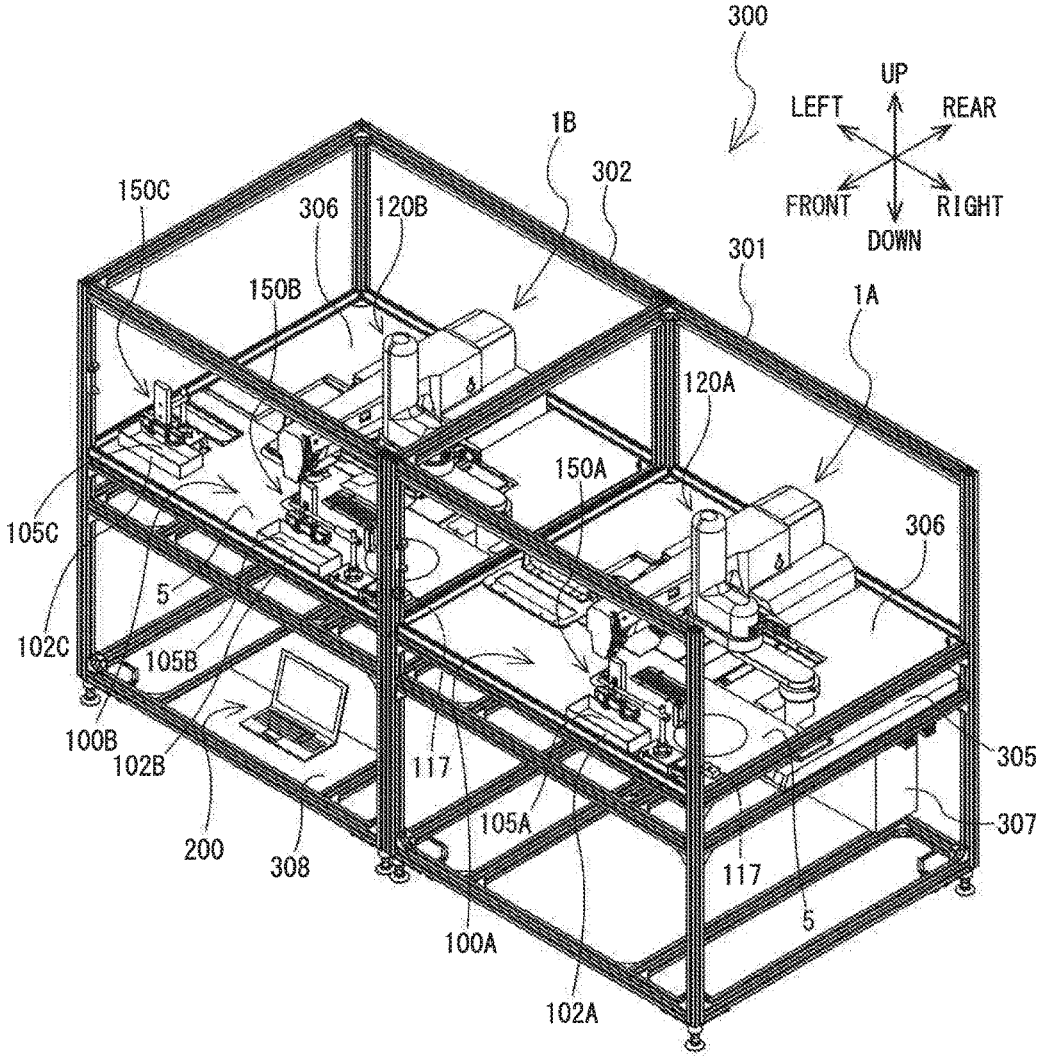
FIG. 1 is a perspective view of a conveyance system 300.

An embodiment of the present disclosure will be explained with reference to the drawings. An outline configuration of a conveyance system 300 will be explained. In the following explanation, left, right, front, rear, up, and down directions, as indicated by arrows in the drawings, will be used.

As shown in FIG. 1, the conveyance system 300 is provided with two sewing machines 1A and 1B, two conveyance devices 100A and 100B, and one PC 200. The sewing machines 1A and 1B have substantially the same configuration. In the following explanation, the sewing machines 1A and 1B will be collectively called the sewing machine 1 or the sewing machines 1. The conveyance devices 100A and 100B have substantially the same configuration. In the following explanation, the conveyance devices 100A and 100B will be collectively called the conveyance device 100 or the conveyance devices 100.

The conveyance system 300 has two frames 301 and 302 that are formed by interlocking iron or aluminum bar members in a rectangular shape. The frame 301 is disposed to the right of the frame 302. The frames 301 and 302 are provided with shelf plates 305 at a middle level. The sewing machine 1A is fixed on the shelf plate 305 of the frame 301. The conveyance device 100A is provided to the right of the sewing machine 1A. The sewing machine 1B is fixed on the shelf plate 305 of the frame 302. The conveyance device 100B is provided to the right of the sewing machine 1B.

The conveyance device 100A is provided with a movement mechanism 120A and a cloth clamping device 150A. The movement mechanism 120A is provided to the right of the sewing machine 1A and is fixed on the shelf plate 305. The cloth clamping device 150A is provided to the right and to the front of the sewing machine 1A, and a cloth box 102A is provided near the cloth clamping device 150A. The cloth box 102A stores cloths 105A to be sewn by the sewing machine 1A, and the cloths 105A are stacked on top of each other. The cloth clamping device 150A and the cloth box 102A are fixed the accessory plate 5 of the sewing machine 1A.

The conveyance device 100B is provided with a movement mechanism 120B, a cloth clamping device 150B, and a cloth clamping device 150C. The movement mechanism 120B is provided to the right of the sewing machine 1B and is fixed on the shelf plate 305. The cloth clamping device 150B is provided to the right and to the front of the sewing machine 1B, and a cloth box 102B is provided near the cloth clamping device 150B. The cloth box 102B stores cloths 105B to be sewn by the sewing machine 1B, and the cloths 105B are stacked on top of each other. The cloth clamping device 150B and the cloth box 102B are fixed on the accessory plate 5 of the sewing machine 1B. The cloth clamping device 150C is provided to the left and to the front of the sewing machine 1B, and a cloth box 102C is provided near the cloth clamping device 150C. The cloth box 102C stores cloths 105C on which the sewing by the sewing machine 1B is finished, and the cloths 105C are stacked on top of each other. The cloth clamping device 150C and the cloth box 102C are fixed on the accessory plate 5 of the sewing machine 1B. The frames 301 and 302 are provided with plates 306, which are provided on both sides to the left and the right of the sewing machines 1A and 1B and at substantially the same height as the accessory plates 5.

The movement mechanism 120A and the movement mechanism 120B have substantially the same configuration. In the following explanation, the movement mechanism 120A and the movement mechanism 120B will be collectively called the movement mechanism 120 or the movement mechanisms 120. The cloth clamping device 150A, the cloth clamping device 150B, and the cloth clamping device 150C have substantially the same configuration. In the following explanation, the cloth clamping device 150A, the cloth clamping device 150B, and the cloth clamping device 150C will be collectively called the cloth clamping device 150 or the cloth clamping devices 150. The cloth box 102A, the cloth box 102B, and the cloth box 102C have substantially the same configuration. In the following explanation, the cloth box 102A, the cloth box 102B, and the cloth box 102C will be collectively called the cloth box 102 or the cloth boxes 102. When the cloth 105A, the cloth 105B, and the cloth 105C are explained in general, they are referred to as the cloth 105 or the cloths 105.

Figure 7:
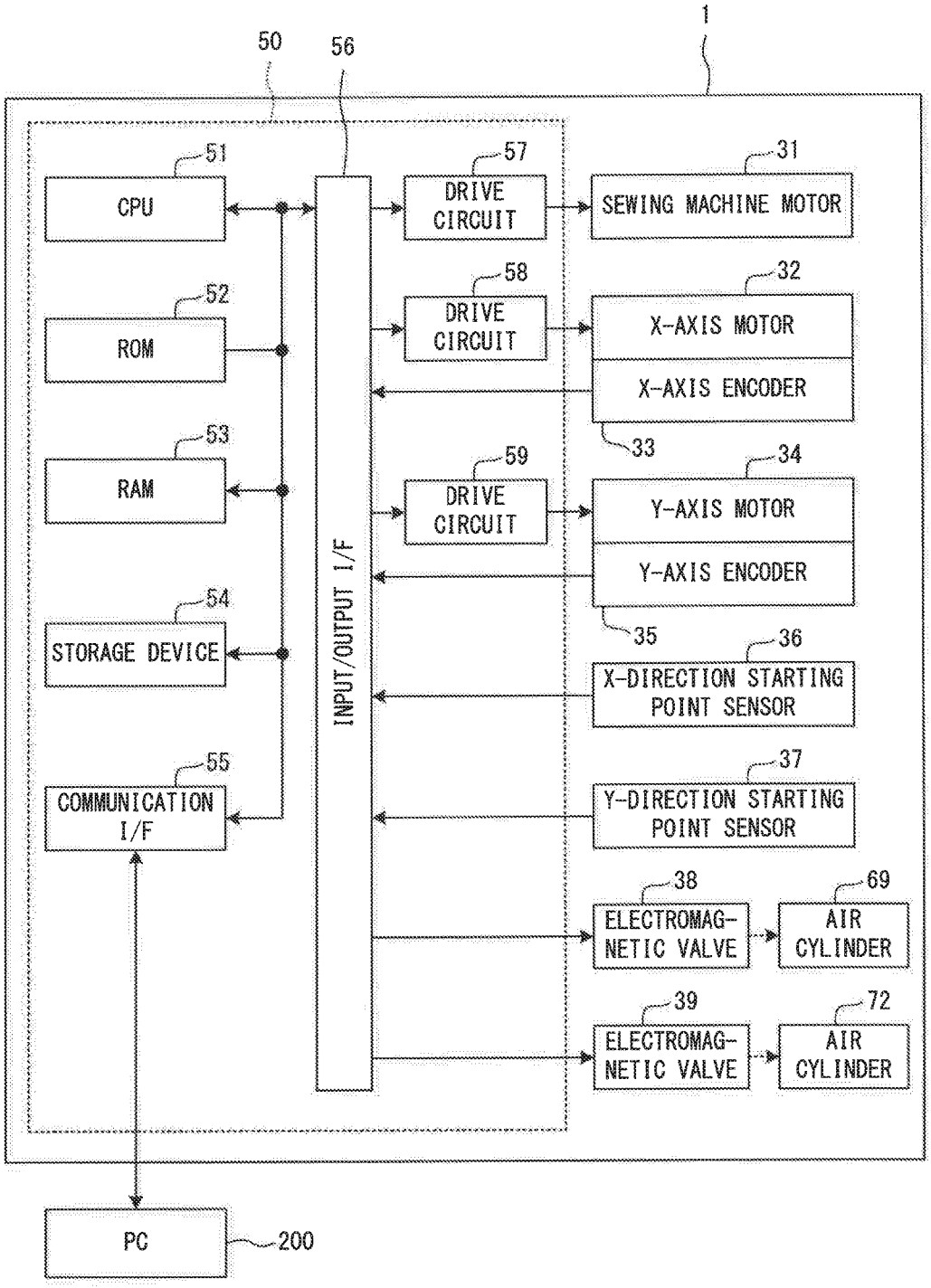
FIG. 7 is a block diagram showing an electrical configuration of the sewing machine 1.
Figure 8:
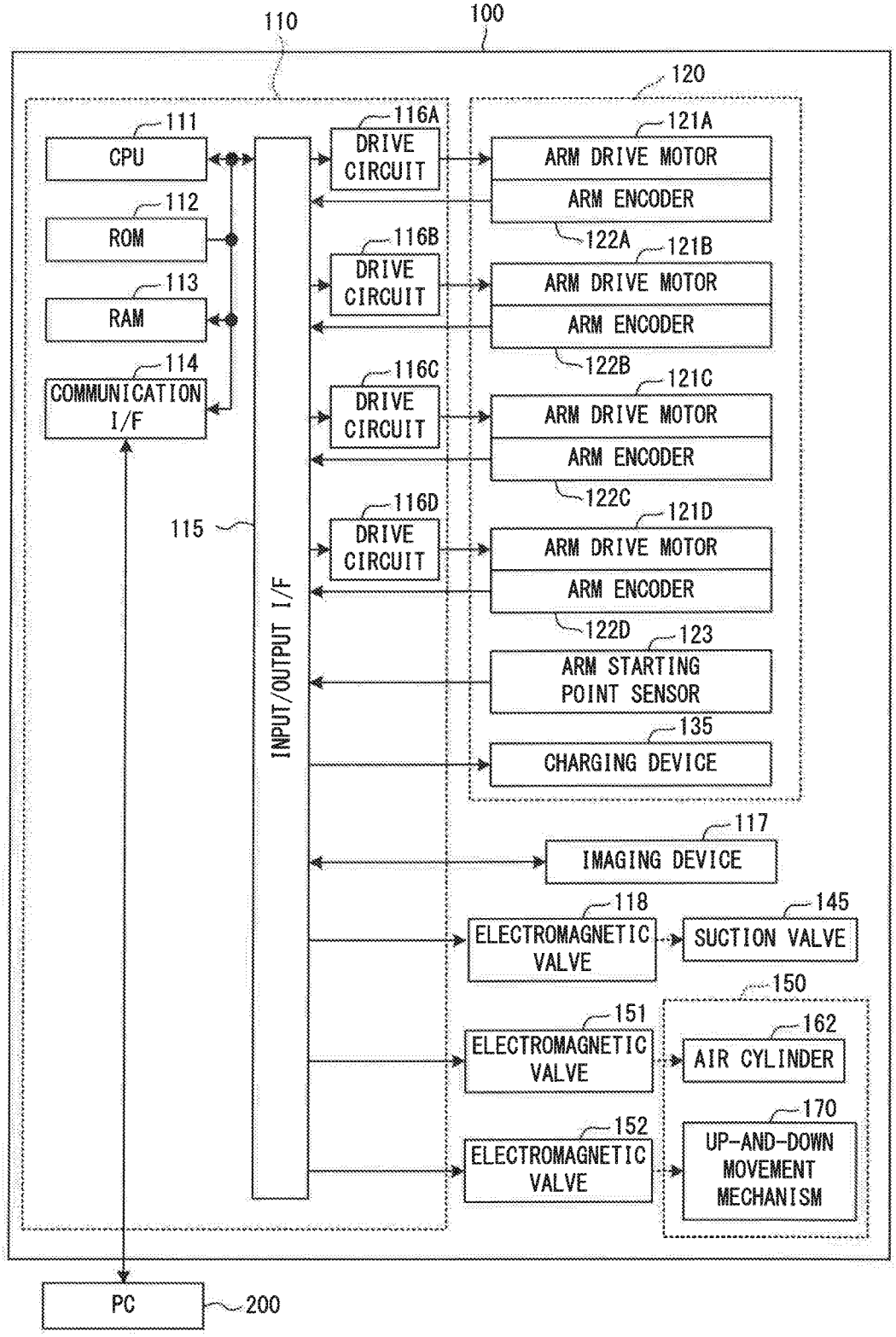
FIG. 8 is a block diagram showing an electrical configuration of the conveyance device 100.
Figure 9:
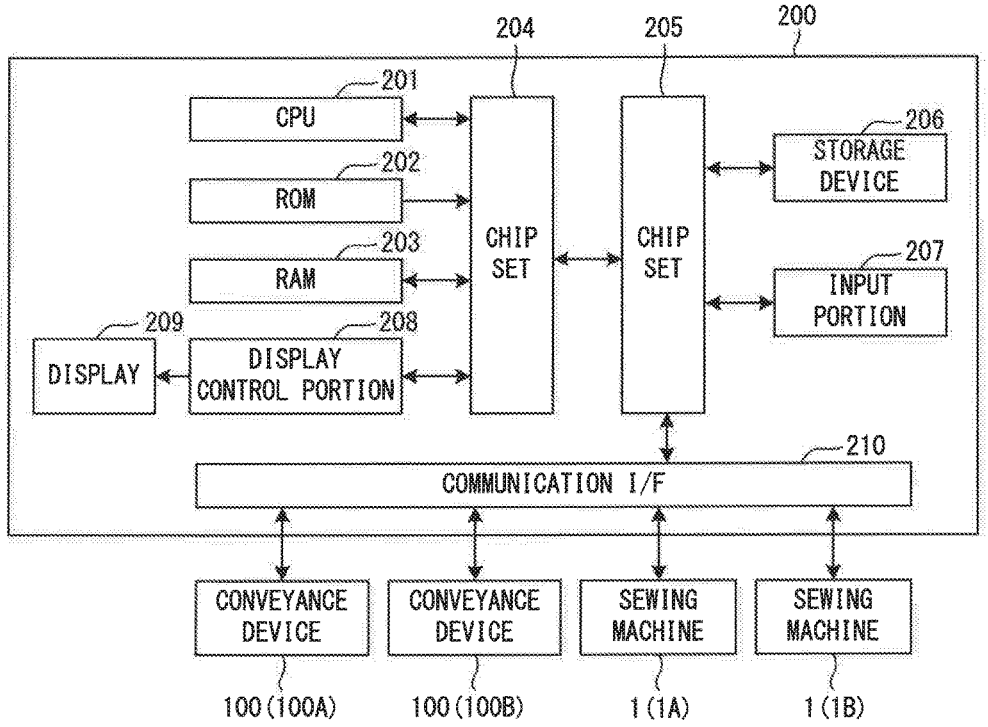
FIG. 9 is a block diagram showing an electrical configuration of a PC 200.

The sewing machines 1 and the conveyance devices 100 are provided with control boxes 307 that house respective control portions 50 and 110 (refer to FIG. 7 and FIG. 8). The control boxes 307 are respectively provided below the shelf plates 305 of the frames 301 and 302. A protective plate (not shown in the drawings) is attached to each of the frames 301 and 302. The protective plate is made of reinforced glass or a transparent acrylic plate and is provided on an upper level at the front of the frames 301 and 302. The protective plate is opened and closed by sliding to the left and the right.

The frame 302 is provided with a lower level shelf plate 308. The PC 200 is disposed on the shelf plate 308. The PC 200 is electrically connected to the control portions 50 of the sewing machines 1 and the control portions 110 of the conveyance devices 100, respectively. The PC 200 is a notebook type, for example, and controls operations of the sewing machines 1 and the conveyance devices 100.

The sewing machine 1 has a bed portion 2, a pillar portion 3, and an arm portion 4. The bed portion 2 is disposed above the shelf plate 305. The bed portion 2 extends in the front-rear direction, and a perpendicular shuttle and the like (not shown in the drawings) are provided inside the bed portion 2. The pillar portion 3 extends upward from the rear side of the bed portion 2. A sewing machine motor 31 (refer to FIG. 7) and the like are provided inside the pillar portion 3. The arm portion 4 extends to the front from the upper end of the pillar portion 3 so as to face the upper surface of the bed portion 2, and a front end portion 7 is provided on the front end of the arm portion 4. A drive shaft, a needle bar drive mechanism (not shown in the drawings) and the like are provided inside the arm portion 4. A needle bar 10 extends downward from the lower end of the front end portion 7. A sewing needle 11 is mounted on the lower end of the needle bar 10.

The sewing machine 1 is provided with the accessory plate 5 and a horizontal movement mechanism 6 above the bed portion 2. The accessory plate 5 is positioned below the sewing needle 10 and has an upper surface that extends in the horizontal direction. The accessory plate 5 is provided with a needle plate 12. The upper surface of the needle plate 12 and the upper surface of the accessory plate 5 are substantially the same height. The needle plate 12 has a needle hole 13 positioned directly below the sewing needle 11 mounted on the needle bar 10 such that the needle 11 can be inserted into the needle hole 13.

Figure 2:
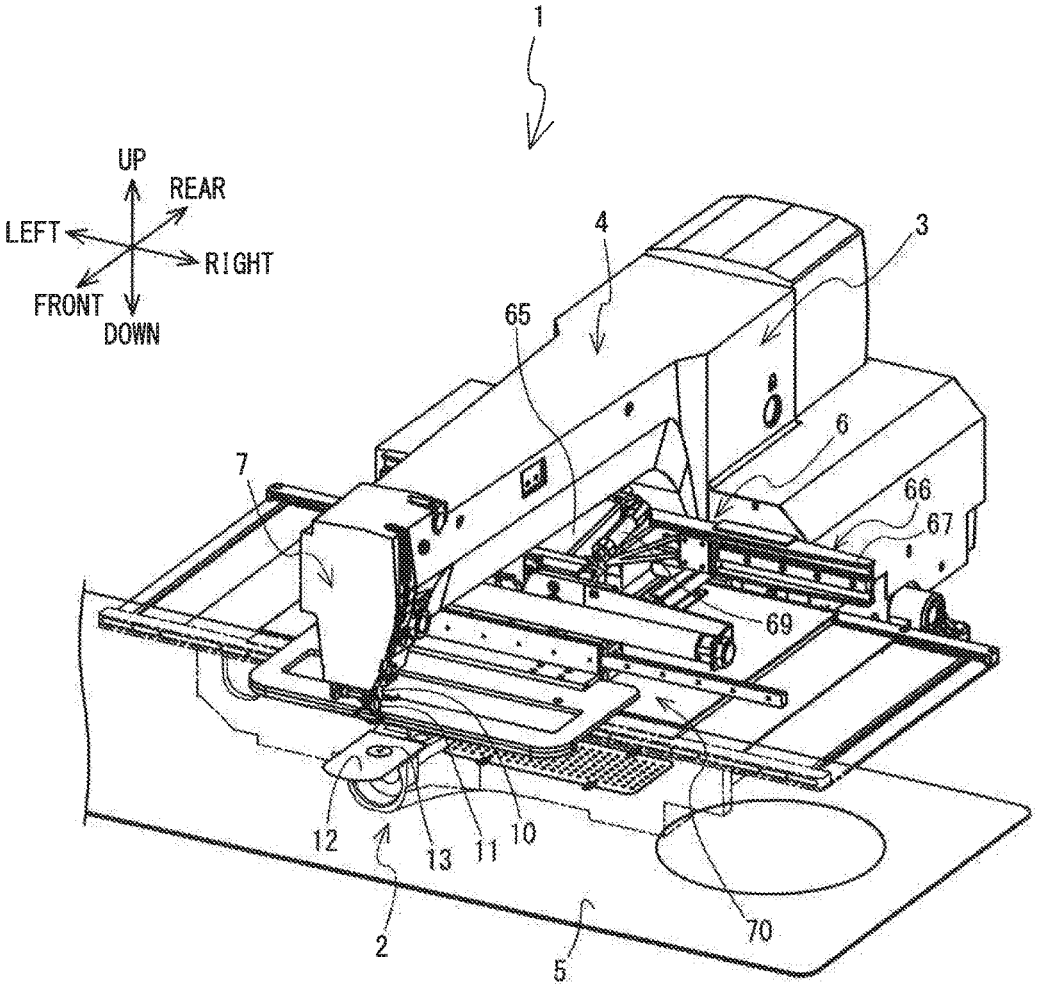
FIG. 2 is a perspective view of a sewing machine 1.
Figure 3:
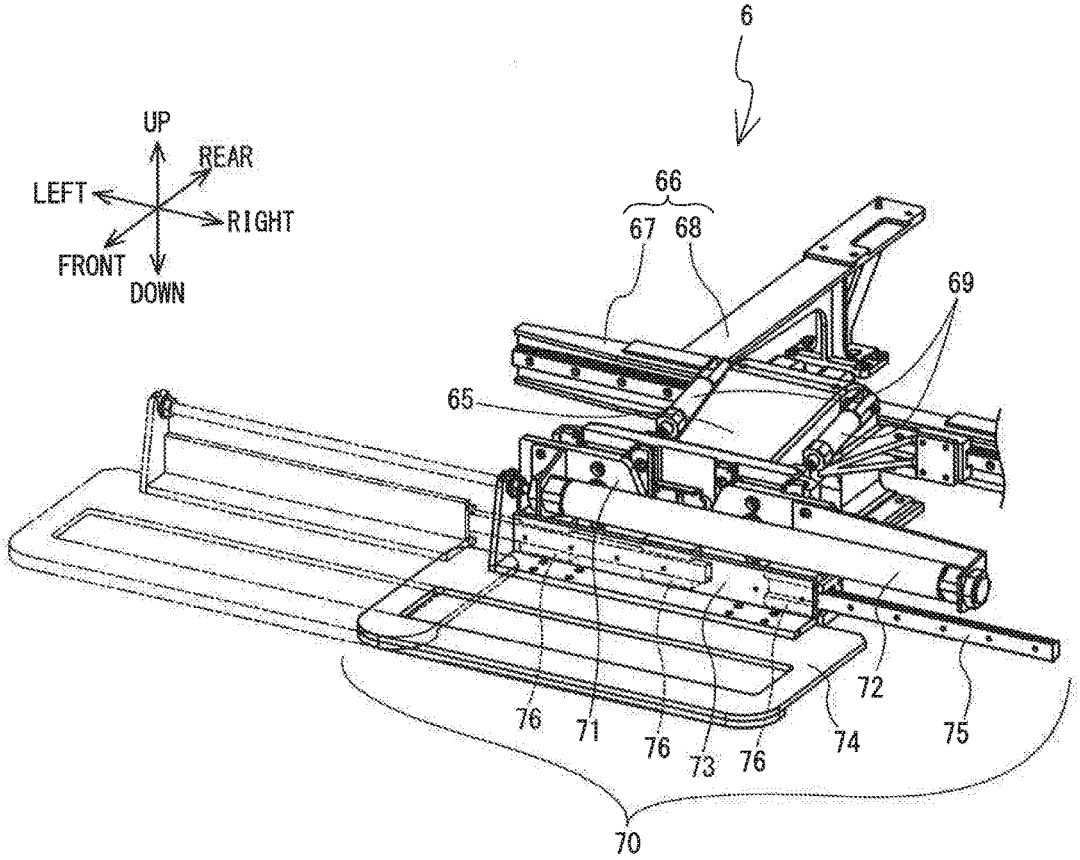
FIG. 3 is a perspective view of a horizontal movement mechanism 6.

As shown in FIG. 2 and FIG. 3, the horizontal movement mechanism 6 is provided with a presser arm 65, an X movement plate (not shown in the drawings), a Y movement arm 66, an air cylinder 69, an X-axis movement mechanism (not shown in the drawings), a Y-axis movement mechanism (not shown in the drawings), and a holding body 70. The X-axis movement mechanism is provided inside the bed portion 2. The X-axis movement mechanism is driven by an X-axis motor 32 (refer to FIG. 7) and moves the X movement plate in the X-axis direction (the left-right direction). The upper surface of the X movement plate is provided with a rail (not shown in the drawings) that extends in the front-rear direction. The presser arm 65 is provided on the rail and can move in the front-rear direction along the rail. The presser arm 65 is positioned higher than the accessory plate 5. The presser arm 65 moves in the X-axis direction along with the X movement plate.

The Y movement arm 66 is provided with a support portion 67 and an arm portion 68. The support portion 67 extends in the left-right direction. The support portion 67 supports a rear portion of the presser arm 65 such that the presser arm 65 can move in the X-axis direction. The arm portion 68 is connected to the rear side of the support portion 67, and extends in the front-rear direction. The arm portion 68 is connected to the Y-axis movement mechanism provided inside the bed portion 2. The Y-axis movement mechanism is driven by a Y-axis motor 34 (refer to FIG. 7) and moves the arm portion 68 in the Y-axis direction (the front-rear direction). The support portion 67 moves in the Y-axis direction in accordance with the movement of the arm portion 68. The presser arm 65 moves in the Y-axis direction along with the Y movement arm 66.

The holding body 70 is attached to a front end portion of the presser arm 65. The holding body 70 is provided with a raising/lowering plate 71, an air cylinder 72, a presser foot 73, a presser plate 74, a rail 75, and a slider 76. The presser arm 65 is provided with a pair of air cylinders 69 on the left and the right. Rods of the air cylinders 69 are connected to a raising/lowering lever (not shown in the drawings). The raising/lowering plate 71 is connected to the raising/lowering lever, and moves up and down in accordance with the driving of the air cylinders 69. The air cylinder 72 and the slider 76 are fixed to the front surface of the raising/lowering plate 71. A rod of the air cylinder 72 extends and contracts in the leftward direction. The presser foot 73 has an L shape in a side view, and is connected to a left end portion of the rod of the air cylinder 72. The presser foot 73 moves to the left and the right in accordance with the driving of the air cylinder 72. The rail 75 extends in the left-right direction, and is fixed to the rear surface of the presser foot 73. The slider 76 is engaged with the rail 75 and supports the presser foot 73 such that the presser foot 73 can move in the left-right direction.

The presser plate 74 is made of metal, for example, and is fixed to a lower end portion of the presser foot 73. The presser plate 74 is a plate member that is disposed in the horizontal direction, and has a rectangular-shaped opening in a plan view. When the air cylinders 69 operate and lower the raising/lowering plate 71, the presser plate 74 and the accessory plate 5 clamp the cloth 105 (the object to be sewn) from above and below and thus hold the cloth 105. When the air cylinders 69 operate and raise the raising/lowering plate 71, the presser plate 74 separates upward and away from the accessory plate 5, and releases the hold on the cloth 105. When the air cylinder 72 operates and causes the presser foot 73 to be moved to the front of the raising/lowering plate 71, the presser plate 74 is positioned in a "front position" which is directly in front of the presser arm 65. As shown by two-dot chain lines in FIG. 3, when the air cylinder 72 operates and causes the presser foot 73 to be moved to the left of the raising/lowering plate 71, the presser plate 74 is positioned in a "side position" in which the presser plate 74 has moved to the left from directly in front of the presser arm 65.

Figure 4:
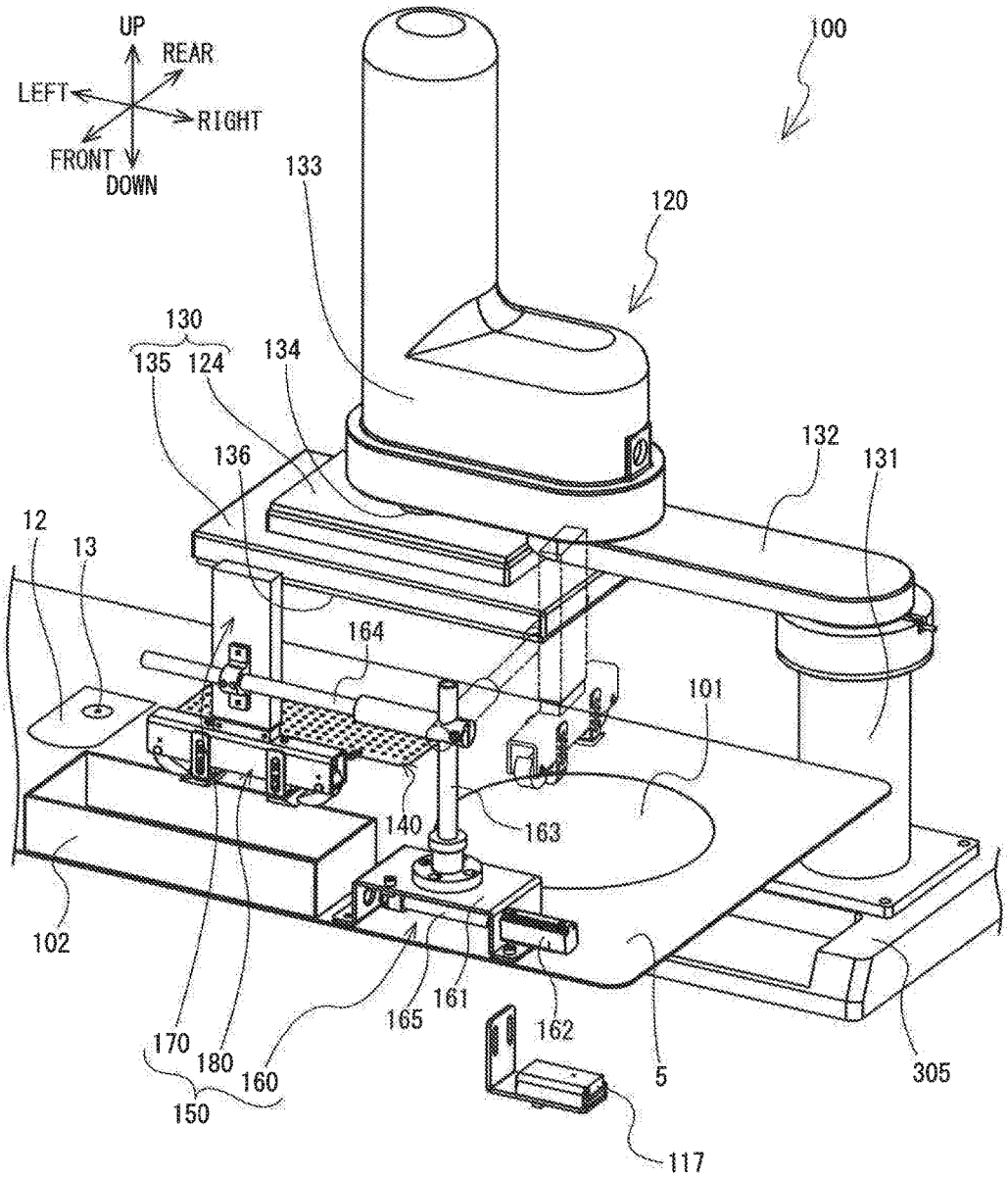
FIG. 4 is a perspective view of a conveyance device 100.

As shown in FIG. 4, the conveyance device 100 is provided with the movement mechanism 120, a suction adhesion mechanism 130, the cloth clamping device 150, an imaging device 117, and a suction mechanism 140. The movement mechanism 120 is internally provided with a plurality of arm drive motors 121A to 121D (refer to FIG. 8). The movement mechanism 120 has a support pillar portion 131, a first arm portion 132, a second arm portion 133, and a third arm portion 134. The support pillar portion 131 extends in the up-down direction and a lower end portion of the support pillar portion 131 is fixed on the shelf plate 305. An upper end portion of the support pillar portion 131 is coupled to one end portion of the first arm portion 132, and supports the first arm portion 132 such that the first arm portion 132 can pivot horizontally. One of the arm drive motors 121A is provided inside the upper end portion of the support pillar portion 131, and the first arm portion 132 pivots due to the driving of the arm drive motor 121A. The first arm portion 132 extends in the horizontal direction. The other end of the first arm portion 132 is coupled to one end portion of the second arm portion 133, and supports the second arm portion 133 such that the second arm portion 133 can pivot horizontally. The second arm portion 133 extends in the horizontal direction, and the other end portion of the second arm portion 133 extends in the up-down direction. One of the arm drive motors 121B is provided inside the one end portion of the second arm portion 133, and the second arm portion 133 pivots relative to the first arm portion 132 due to the driving of the arm drive motor 121B.

The third arm portion 134 is rod shaped and extends in the up-down direction. The other end of the second arm portion 133 holds the third arm portion 134 such that the third arm portion 134 can move up and down, and can also rotate around an axial center of the third arm portion 134. Two of the arm drive motors 121C and 121D are provided inside the other end of the second arm portion 133, and the third arm portion 134 moves up and down and rotates due to the driving of the arm drive motors 121C and 121D. A mount 124 of the suction adhesion mechanism 130 is connected to a lower end portion of the third arm portion 134.

The adhesion mechanism 130 is provided with the mount 124 and a charging device 135. The mount 124 is a plate member having a substantially rectangular shape in a plan view. The charging device 135 is charged by being energized. The charging device 135 has a substantially rectangular plate shape in a plan view, and is fixed to a lower portion of the mount 124. The lower surface of the charging device 135 is an adhesion surface 136. The charging device 135 is charged with static electricity as a result of being electrically charged, and can cause the cloth 105 to be attracted to and adhere to the adhesion surface 136. The control portion 110 (refer to FIG. 8) of the conveyance device 100 controls each of the plurality of arm drive motors 121A to 121D, and can move the charging device 135 to a desired position, at a desired orientation, within a movable range of the movement mechanism 120 on the accessory plate 5.

Figure 5:
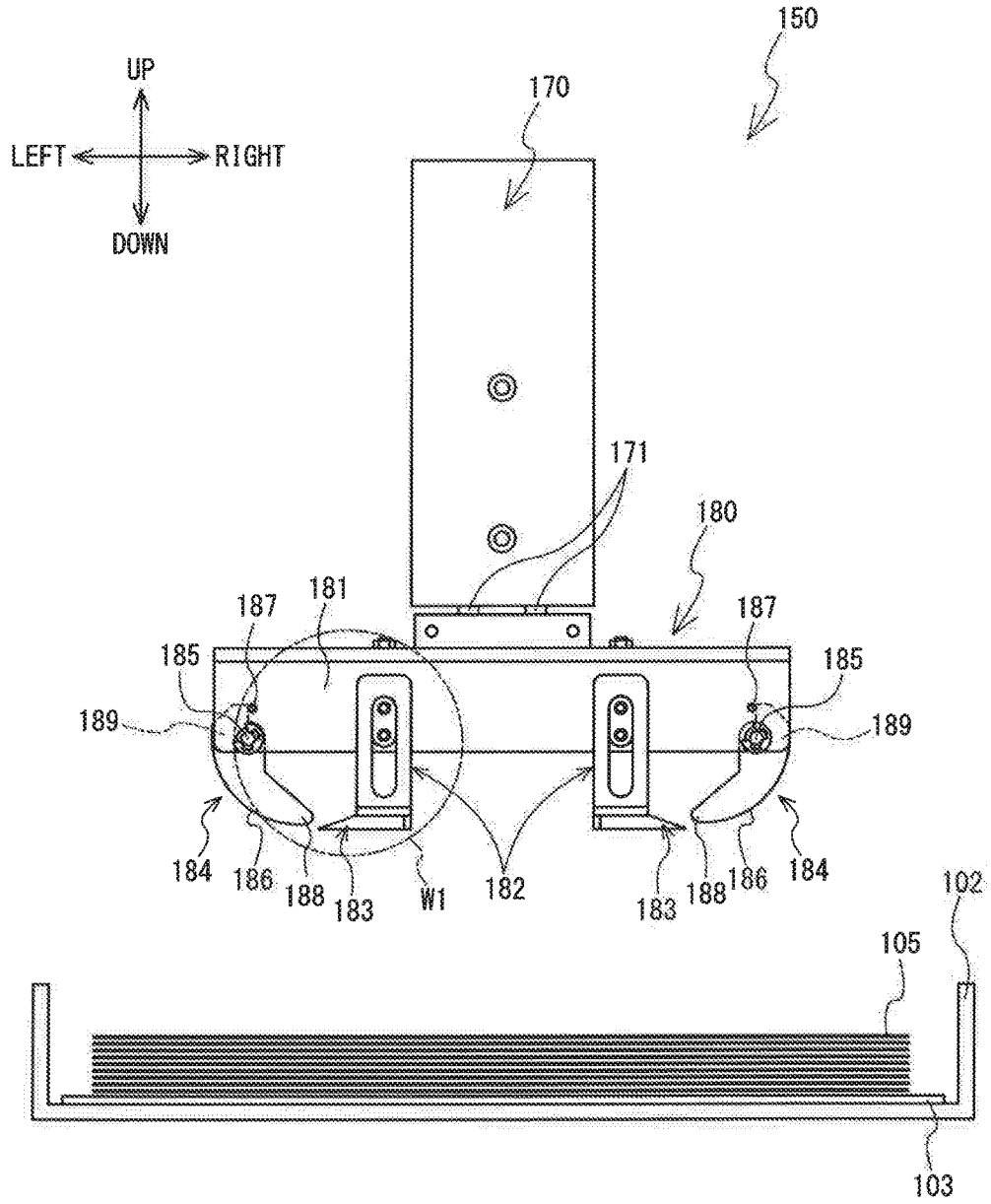
FIG. 5 is a front view of a cloth clamping device 150.

The cloth clamping device 150 removes one of the cloths 105 from among the plurality of cloths 105 stacked on top of each other. The cloth clamping device 150 is provided with a pivoting mechanism 160, an up-and-down movement mechanism 170, and a clamping mechanism 180. The pivoting mechanism 160 is provided with a pedestal portion 161, an air cylinder 162, a support pillar 163, and a pivoting arm 164. The pedestal portion 161 is box-shaped, and a bottom portion thereof is fixed on the accessory plate 5. The support pillar 163 is rod-shaped and extends in the up-down direction. The pedestal portion 161 supports the support pillar 163 such that the support pillar 163 can rotate around an axial center thereof. A lower end portion of the support pillar 163 is disposed inside the pedestal portion 161. The air cylinder 162 is provided on a side portion of the pedestal portion 161. A rod 165 of the air cylinder 162 is disposed inside the pedestal portion 161, and extends and contracts in the left-right direction to the side of the support pillar 163. The lower end portion of the support pillar 163 is provided with a pinion gear (not shown in the drawings). The rod 165 of the air cylinder 162 is provided with a rack gear (not shown in the drawings), which meshes with the pinion gear. When the air cylinder 162 is driven, the support pillar 163 rotates. One end of the pivoting arm 164 is fixed to the upper end portion of the support pillar 163. The pivoting arm 164 extends in the horizontal direction, and the up-and-down movement mechanism 170 is fixed to the other end of the pivoting arm 164. As shown in FIG. 5, the up-and-down movement mechanism 170 is a square-shaped air cylinder and is provided with two rods 171 that extend and contract downward. The clamping mechanism 180 is connected to the lower ends of the two rods 171.

Figure 25:
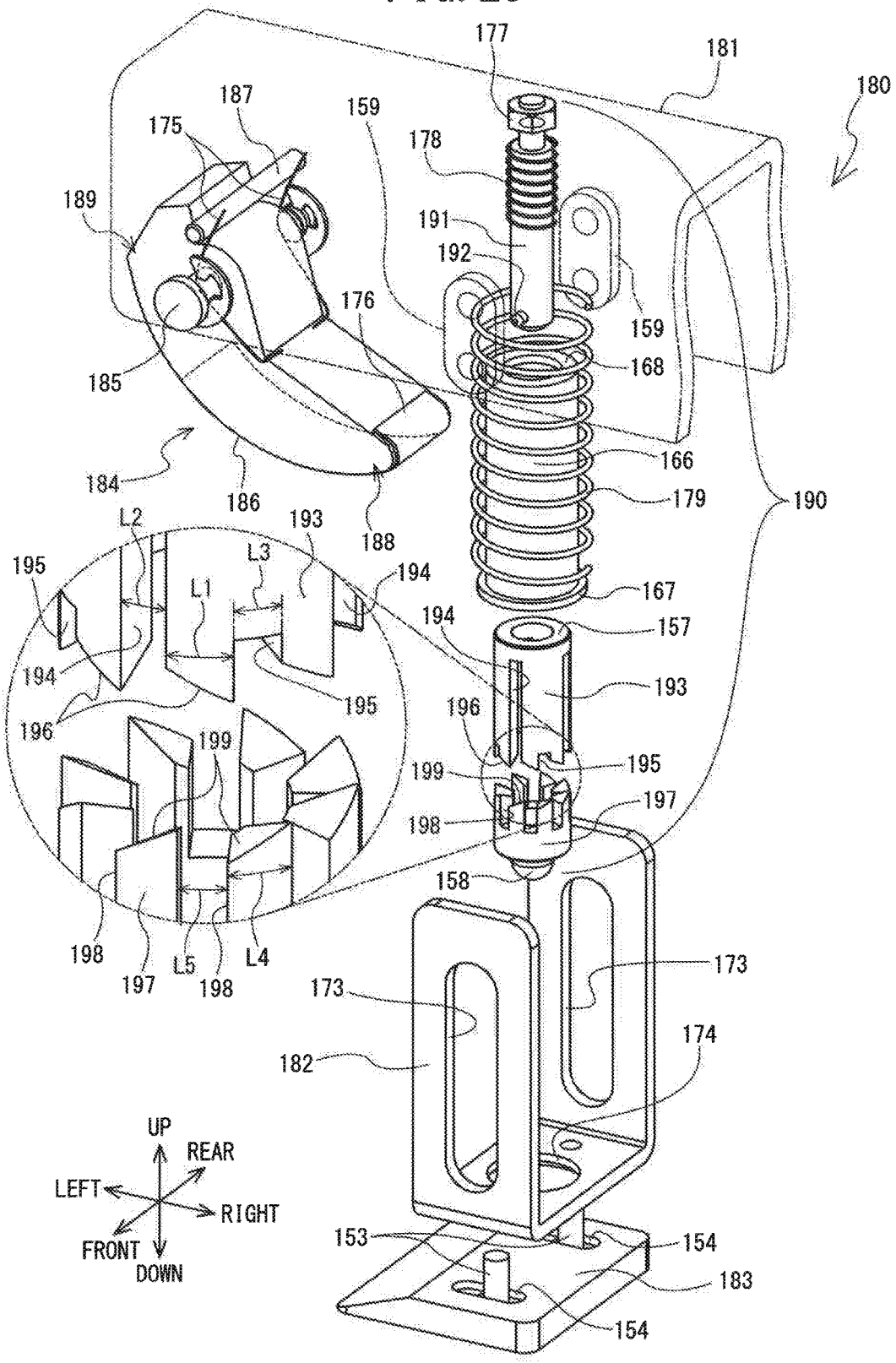
FIG. 25 is an exploded perspective view of a clamping mechanism 180.

As shown in FIG. 5 and FIG. 25, the clamping mechanism 180 is provided with a support portion 181, two leg portions 182, two foot portions 183, two clamping portions 184, and two holding mechanisms 190. The support portion 181 extends in the left-right direction, and is a plate member bent into a reverse U shape in a side view. The lower ends of the rods 171 of the up-and-down movement mechanism 170 are fixed substantially in the center of the upper surface of the support portion 181. The leg portion 182 is a plate-shaped member that is bent into a U shape in a side view. A pair of long holes 173, which extend in the up-down direction, are provided in each of plate-shaped portions of the leg portion 182 that face each other in the front-rear direction, and a round hole portion 174 is formed in a bottom portion of the leg portion 182. A stepped portion 1741 (refer to FIG. 26) is formed in the inner peripheral surface of the hole portion 174. A lower side of the stepped portion 1741 is larger than an upper side thereof in the radial direction. A pair of plate-shaped protruding portions 159 is fixed to the outer side surfaces of portions of the support portion 181 that face each other in the front-rear direction. The protruding portion 159 is an elliptical shape that is long in the up-down direction. The pair of protruding portions 159 are engaged with the pair of long holes 173, and the support portion 181 thus supports the leg portions 182 such that the leg portions 182 can move up and down within a range of the long holes 173. The leg portions 182 move up and down between an "upper position" (refer to FIG. 11) in which they are positioned at a higher level relative to the support portion 181, and a "lower position" (refer to FIG. 5) in which they are positioned lower than the upper position. Lower end portions of the leg portions 182 protrude below the support portion 181.

When the leg portions 182 have moved from the lower position to the upper position, the holding mechanism 190 can hold the leg portions 182 in the upper position. The holding mechanism 190 is provided with a support rod 191, a pin 192, a cam member 193, a switching member 197, a protective tube 166, and compression springs 178 and 179. The support rod 191 is rod-shaped and extends in the up-down direction, and is provided inside the support portion 181. An upper end portion of the support rod 191 is fixed to an upper portion of the support portion 181 by a nut 177. The pin 192, which protrudes outward in the radial direction, is provided on a lower end portion of the support rod 191. The pin 192 engages with the cam member 193 and the switching member 197. The compression spring 178 is provided around the support rod 191. The upper end of the compression spring 178 is in contact with the lower surface of the upper portion of the support portion 181, and the lower end of the compression spring 178 comes into contact with an upper surface 157 of the cam member 193. The compression spring 178 urges the cam member 193 downward.

The cam member 193 extends in the up-down direction, is a cylindrical member, and is provided with the upper surface 157 on an upper portion thereof. An opening is formed in the center of the upper surface 157. The outer diameter of the cam member 193 is larger than the outer diameter of the support rod 191. The support rod 191 penetrates through the opening in the upper surface 157, and the lower end portion of the support rod 191 is disposed inside the cam member 193. The inner diameter of the cam member 193 is substantially the same as the outer diameter of the support rod 191. The cam member 193 can rotate in the circumferential direction around the support rod 191. A plurality of guide portions 194 and restraining portions 195 are provided on the side surface of the cam member 193. Each of the guide portions 194 and the restraining portions 195 is a groove shape extending from the lower end of the cam member 193 in the up-down direction. The guide portions 194 and the restraining portions 195 are aligned alternatingly at equal intervals in the circumferential direction of the cam member 193. The cam member 193 is provided with inclined surfaces 196, which are inclined in the up-down direction, on the lower ends of a peripheral wall of the cam member 193 between the guide portions 194 and the restraining portions 195. Each of the inclined surfaces 196 is inclined upward from below in the clockwise direction in a plan view. A length L1 of the inclined surface 196 in the circumferential direction is greater than a width L2 of the guide portion 194 and is greater than a width L3 of the restraining portion 195. The width L2 of the guide portion 194 and the width L3 of the restraining portion 195 are the same size, and are slightly larger than the outer diameter of the pin 192.

The pin 192 engages with the guide portion 194 and the restraining portion 195, and can move in the up-down direction inside the guide portion 194 and the restraining portion 195. The upper ends of the guide portions 194 are higher than the upper ends of the restraining portions 195.

When the leg portion 182 moves between the upper position and the lower position, the guide portions 194 guide the relative up and down movement of the pin 192 with respect to the leg portion 182. When the leg portion 182 moves between the upper position and the lower position, the restraining portions 195 restrain the relative up and down movement of the pin 192 with respect to the leg portion 182.

The switching member 197 extends in the up-down direction and is a cylindrically-shaped member whose outer diameter is substantially the same as that of the cam member 193. The switching member 197 is disposed below the cam member 193, and the lower end portion of the support rod 191 enters into the switching member 197 from an upper opening. A hemispherical shaft portion 158 is provided on a lower portion of the switching member 197. The shaft portion 158 comes into contact with the upper surface of the foot portion 183, via the hole portion 174 of the leg portion 182. A shaft center of the shaft portion 158 is aligned with a shaft center of the switching member 197. The switching member 197 can rotate in the circumferential direction around the shaft center of the shaft portion 158. The inner diameter of the switching member 197 is substantially the same as the outer diameter of the support rod 191. A plurality of groove portions 198 are formed in the side surface of the switching member 197. Each of the groove portions 198 is a groove shape extending in the up-down direction from the upper end of the switching member 197. The plurality of groove portions 198 are aligned side by side at equal intervals in the circumferential direction of the switching member 197. Inclined surfaces 199, which are inclined in the up-down direction, are formed on the upper ends of a peripheral wall of the switching member 197 between each of the groove portions 198. Each of the inclined surfaces 199 is inclined downward from above in the clockwise direction in a plan view. A length L4 of the inclined surface 199 in the circumferential direction is greater than a width L5 of the groove portion 198. The width L5 of the groove portion 198 is slightly larger than the outer diameter of the pin 192.

The pin 192 engages with the groove portion 198 and can move in the up-down direction inside the groove portion 198. When the leg portion 182 is in the upper position, the groove portions 198 guide the relative up and down movement of the pin 192 with respect to the leg portion 182. Each time the leg portion 182 moves up-and-down once with respect to the support portion 181, the switching member 197 switches the section at which the pin 192 engages with the cam member 193 to be alternatingly the guide portion 194 and the restraining portion 195.

The protective tube 166 is a cylindrically-shaped member that extends in the up-down direction and that has an upper wall 168 on an upper portion thereof. A size of the protective tube 166 in the up-down direction is larger than a size obtained by aligning the cam member 193 and the switching member 197 in the up-down direction. The inner diameter of the protective tube 166 is slightly larger than the outer diameter of the cam member 193 and the switching member 197. The protective tube 166 surrounds the outer side surfaces of the cam member 193 and the switching member 197 in the circumferential direction. A rim portion 167, which protrudes outward in the radial direction, is provided on a lower end portion of the protective tube 166. The rim portion 167 engages with the stepped portion 1741 of the hole portion 174 of the leg portion 182 from below. The upper wall 168 of the protective tube 166 has an opening. The inner diameter of the opening of the upper wall 168 is larger than the outer diameter of the compression spring 178 provided around the support rod 191, and is smaller than the outer diameter of the cam member 193. The lower surface of the upper wall 168 engages with the upper surface 157 of the cam member 193. The compression spring 178 urges the cam member 193 downward without any interference with the protective tube 166.

The compression spring 179 is provided around the protective tube 166. The upper end of the compression spring 179 comes into contact with the lower surface of the upper portion of the support portion 181, and the lower end of the compression spring 179 comes into contact with a bottom portion of the leg portion 182. The compression spring 179 urges the leg portion 182 downward.

The two foot portions 183 are respectively fixed, using screws 153, to the lower surfaces of the bottom portions of the leg portions 182. Each of the foot portions 183 is plate-shaped, and protrudes to the side of each of the leg portions 182. The upper surface of the foot portion 183 comes into contact with the rim portion 167 of the protective tube 166. The foot portion 183 integrally assembles the protective tube 166 and the leg portion 182. The foot portion 183 has two long holes 154 that extend in the protruding direction of the foot portion 183. The screws 153 are inserted into the long holes 154. A degree of protrusion of the foot portion 183 to the side can be adjusted, since the screws 153 can be moved in the range of the long holes 154.

The two clamping portions 184 are respectively provided to the sides of the leg portions 182. The foot portions 183 protrude toward the clamping portions 184. Shaft rods 185, which extend between a front wall and a rear wall of the support portion 181, are respectively provided on both left and right end portions of the support portion 181. The shaft rods 185 are inserted into base end portions 189 of the clamping portions 184, and rotatably support the clamping portions 184. Leading end portions 188 of the clamping portions 184 are located in a center side, in the left-right direction, of the support portion 181 related to the base end portions 189. The support portion 181 is provided with torsion springs 175 on the shaft rods 185. The torsion springs 175 urge the leading end portions 188 of the clamping portions 184 toward a position below the base end portions 189. At this time, the clamping portions 184 are positioned in an "open position" in which the leading end portions 188 face the foot portions 183 from the side. When the clamping portions 184 have rotated while resisting the urging force of the torsion springs 175, the clamping portions 184 are positioned in a "closed position" in which the leading end portions 188 are positioned above the foot portions 183.

The support portion 181 is provided with stoppers 187 above the shaft rods 185. Each of the stoppers 187 extends between the front wall and the rear wall of the support portion 181. When the clamping portions 184 are positioned in the open position, the stoppers 187 come into contact with the base end portions 189, and maintain the leading end portions 188 in the position to the side of the foot portions 183. Each of the clamping portions 184 has a curved surface 186, which is provided between the leading end portion 188 and the base end portion 189, and which is curved downward. Each of the clamping portions 184 is provided with a pad 176, from the surface of the leading end portion 188 covering the curved surface 186, and a frictional force of the pad 176 with respect to the cloth 105 is greater than a frictional force between the cloths 105. The pad 176 is formed as a sheet made of rubber, silicone or the like, and is adhered to the clamping portion 184. When the clamping portions 184 pivot from the open position to the closed position, the clamping portions 184 use the pads 176 to draw up the cloth 105 toward the foot portions 182 while causing the curved surfaces 186 to come into contact with the cloth 105. The pads 176 have elasticity, and thus, when the clamping portions 184 draw up the cloth 105, the load on the cloth 105 can be reduced.

A gap between each of the foot portions 183 and the leading end portions 188 of the clamping portions 184 can be changed in accordance with a positional relationship of the screws 153 and the long holes 154 when the foot portions 183 are fixed to the foot portions 182 using the screws 153. The gap between each of the foot portions 183 and the clamping portions 184 is adjusted in accordance with the thickness, the material and the like of the cloth 105, for example. When the cloth 105 is thin, the gap between each of the foot portions 183 and the clamping portions 184 is made smaller. By reducing the gap between each of the foot portions 183 and the clamping portions 184, the clamping mechanism 180 can inhibit a plurality of the cloths 105 from being clamped between the clamping portions 184 and the foot portions 183 when the cloth 105 is drawn up by the clamping portions 184. When the cloth 105 is thick, the gap between each of the foot portions 183 and the clamping portions 184 is made larger. By increasing the gap between each of the foot portions 183 and the clamping portions 184, when the cloth 105 is drawn up by the clamping portions 184, the clamping mechanism 180 can inhibit a failure to clamp the cloth 105 between the clamping portions 184 and the foot portions 183.

As shown in FIG. 4, the accessory plate 5 is provided with a circular window portion 101, to the rear of the pedestal portion 161. A reinforced glass or transparent acrylic plate is provided in the window portion 101. The frames 301 and 302 fix the imaging devices 117 below each of the window portions 101. The imaging device 117 captures an image above the accessory plate 5, via the window portion 101. When the movement mechanism 120 has moved the charging device 135 to an "imaging position" above the window portion 101, the imaging device 117 captures an image of the adhesion surface 136 of the charging device 135, and of the cloth 105 adhered to the adhesion surface 136.

The cloth box 102 is provided to the left of the pedestal portion 161, and is fixed on the accessory plate 5. The cloth box 102 has a substantially rectangular shape in a plan view, and is longer in the left-right direction than in the front-rear direction. The cloths 105 that are the objects to be sewn are stacked inside the cloth box 102. A pad 103 (refer to FIG. 5) is provided on the bottom surface of the cloth box 102. The pad 103 is formed as a sheet a member made of rubber, silicone or the like and, and suppresses slipping of the cloths 105 stored inside the cloth box 102. A frictional force of the pad 103 with respect to the cloth 105 is greater than the frictional force between the cloths 105. The frictional force of the pad 176 of the clamping portion 184 is greater than the frictional force of the pad 103 of the cloth box 102. Thus, when the last cloth 105 is clamped and removed from the cloth box 102, the clamping mechanism 180 can draw up the cloth 105 using the pad 176 while resisting the pad 103.

The cloth 105 of the present embodiment has a substantially rectangular shape, and is stored inside the cloth box 102 with the longer edges thereof extending in the left-right direction. When the clamping mechanism 180 clamps and removes the single cloth 105 from the cloth box 102, the pivoting mechanism 160 causes the up-and-down movement mechanism 170 and the clamping mechanism 180 to move to a position above the cloth box 102. As shown by the two-dot chain lines in FIG. 4, each of the pivoting mechanisms 160 of the cloth clamping device 150A and 150B pivots the support pillar 163 by substantially 90 degrees, and moves the up-and-down movement mechanism 170 and the clamping mechanism 180 from above the cloth box 102A and 102B to a position above the window portion 101. The pivoting mechanism 160 of the cloth clamping device 150C pivots the support pillar 163 by substantially 180 degrees, and moves the up-and-down movement mechanism 170 and the clamping mechanism 180 from above the cloth box 102C. A position in the vicinity of the window portion 101 on the accessory plate 5 is a "placement position." The cloth clamping device 150 places the single cloth 105 removed from the cloth box 102 in the placement position. The movement mechanism 120 moves the charging device 135 to the placement position, and accepts the cloth 105.

Figure 6:
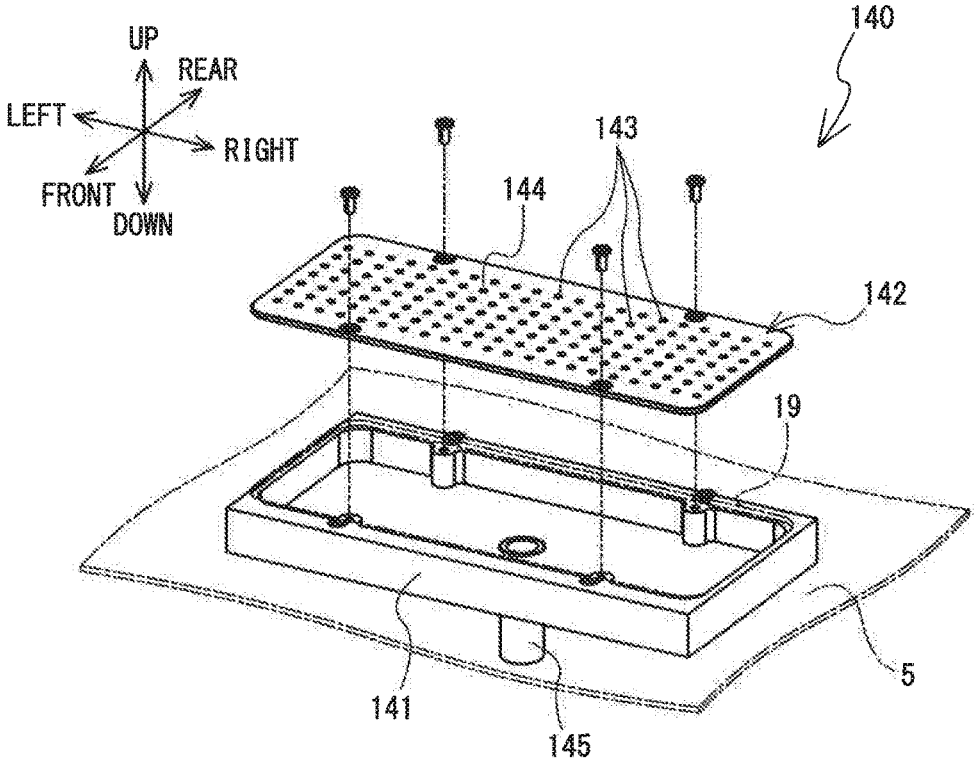
FIG. 6 is a perspective view of a suction mechanism 140.

The accessory plate 5 has an opening 19, to the rear of the cloth box 102. The opening 19 has a substantially rectangular shape in a plan view, and is longer in the left-right direction than in the front-rear direction. As shown in FIG. 6, the suction mechanism 140 is provided in the opening 19, and is fixed on the lower side of the accessory plate 5. The suction mechanism 140 is provided with a suction box 141, a circulation plate 142, and a suction valve 145. The suction box 141 is box-shaped and a top portion thereof is open. The circulation plate 142 engages with the opening 19 and covers an upper portion of the suction box 141, and the circulation plate 142 is fixed to the suction box 141 using screws. The upper surface of the circulation plate 142 and the upper surface of the accessory plate 5 are at substantially the same height. The circulation plate 142 has a plurality of circulation holes 143 through which air flows. The suction valve 145 is connected to a bottom portion of the suction box 141. The suction valve 145 drives the air, and sucks the air inside the suction box 141. The upper surface of the circulation plate 142 is a suction surface 144 that can suck the cloth 105. The position of the suction surface 144 on the accessory plate 5 is a "transfer position" at which the charging device 135 of the movement mechanism 120 transfers the cloth 105 adhered to the adhesion surface 136 to the presser plate 74 of the horizontal movement mechanism 6. The suction mechanism 140 sucks the cloth 105 placed on the transfer position by the movement mechanism 120, and holds the cloth 105 until the transfer is complete.

The air cylinders 69 and 72 of the sewing machine 1, the air cylinder 162 of the cloth clamping device 150, the up-and-down movement mechanism 170, and the suction valve 145 of the suction mechanism 140 are each connected to an compressor (not shown in the drawings), via tubes.

The control portion 50 of the sewing machine 1 is provided with a CPU 51, a ROM 52, a RAM 53, a storage device 54, a communication interface (I/F) 55, an input/output I/F 56, and drive circuits 57 to 59. The CPU 51, the ROM 52, the RAM 53, and the storage device 54 are each electrically connected to the input/output I/F 56 via a bus. The CPU 51 controls the sewing machine 1, and executes various arithmetic computations and processing relating to sewing, in accordance with various programs stored in the ROM 52. The ROM 52 stores the various programs, and various initial setting parameters and the like. The RAM 53 temporarily stores computation results of the CPU 51, pointers, counters and the like. The storage device 54 is a non-volatile storage device that stores sewing data of a plurality of patterns, various pieces of setting information input by an operator, and the like. The sewing data is data for moving the holding body 70 such that a plurality of needle drop points used to sew a pattern are sequentially positioned directly below the sewing needle 11. The needle drop points are predetermined positions on the cloth 105 at which the sewing needle 11 moves downward together with the needle bar 10 and the sewing needle 11 pierces the cloth 105. A "sewing start position" is a position of the holding body 70 corresponding to the first needle drop point. Coordinates of the needle drop points are coordinates obtained when an origin position of the holding body 70 is used as a reference position. The "origin position" of the holding body 70 is, for example, a position in which a center of the presser plate 74 is directly below the sewing needle 11. The origin position of the holding body 70 is not limited to the example of the present embodiment, and may be a position such that an end portion of the presser plate 74 is located directly below the sewing needle 11, for example.

The communication I/F 55 is electrically connected to the input/output I/F 56. The communication I/F 55 is an interface for serial communication, for example. The communication I/F 55 is connected to a communication I/F 210 of the PC 200. The drive circuits 57 to 59 are electrically connected to the input/output I/F 56. The drive circuit 57 is electrically connected to the sewing machine motor 31. The CPU 51 controls the drive circuit 57, and drives the sewing machine motor 31. The sewing machine motor 31 rotates a drive shaft. The drive circuit 58 is electrically connected to the X-axis motor 32. The drive circuit 59 is electrically connected to the Y-axis motor 34. The CPU 51 controls the drive circuits 58 and 59 and respectively drives the X-axis motor 32 and the Y-axis motor 34. Each of the X-axis motor 32 and the Y-axis motor 34 is a stepping motor. The X-axis motor 32 and the Y-axis motor 34 respectively drive the X-axis movement mechanism and the Y-axis movement mechanism. The holding body 70 moves in the X-axis direction and the Y-axis direction. The X-axis motor 32 and the Y-axis motor 34 are respectively provided with an X-axis encoder 33 and a Y-axis encoder 35, on respective output shafts. The X-axis encoder 33 and the Y-axis encoder 35 are both electrically connected to the input/output I/F 56. The X-axis encoder 33 and the Y-axis encoder 35 detect values corresponding to a rotation angle of the output shafts of the X-axis motor 32 and the Y-axis motor 34, respectively, and output the values to the CPU 51. Based on the values, the CPU 51 computes coordinates of a current position of the holding body 70, and stores the current position coordinates in the RAM 53. The CPU 51 drives the sewing machine motor 31 during the sewing so as to rotate the drive shaft, and controls the up-and-down movement of the needle bar 10 and driving of the perpendicular shuttle. At the same time as driving the sewing machine motor 31, the CPU 51 drives the X-axis motor 32 and the Y-axis motor 34 on the basis of the sewing data, and thus controls driving of the horizontal movement mechanism 6. As a result, the sewing machine 1 sews the cloth 105.

The input/output I/F 56 is electrically connected to an X-direction origin sensor 36, a Y-direction origin sensor 37, and electromagnetic valves 38 and 39. The X-direction origin sensor 36 is provided in the X-axis movement mechanism. The X-direction origin sensor 36 is used to set the origin of the holding body 70. The Y-direction origin sensor 37 is provided in the Y-axis movement mechanism. The Y-direction origin sensor 37 is used to set the origin of the holding body 70. The CPU 51 controls the operation of the X-axis motor 32 and the Y-axis motor 34 on the basis of detection results from the X-direction origin sensor 36 and the Y-direction origin sensor 37. Before starting the sewing, the CPU 51 moves the holding body 70 to the origin position. The electromagnetic valve 38 is provided on a feed path of the air fed to the air cylinder 69 by the compressor. The CPU 51 controls the operation of the air cylinder 69 by opening and closing the electromagnetic valve 38, and thus raises and lowers the presser plate 74. The electromagnetic valve 39 is provided on a feed path of the air fed to the air cylinder 72 of the holding body 70 by the compressor. The CPU 51 controls the operation of the air cylinder 72 by opening and closing the electromagnetic valve 39, and thus moves the presser plate 74 to the left and right.

The control portion 110 of the conveyance device 100 is provided with a CPU 111, a ROM 112, a RAM 113, a communication I/F 114, an input/output I/F 115, and a drive circuits 116A to 116D. The CPU 111, the ROM 112 and the RAM 113 are electrically connected to the input/output I/F 115 via a bus. The CPU 111 controls the conveyance device 100 and executes processing in accordance with various programs stored in the ROM 112. The ROM 112 stores the various programs and various initial setting parameters and the like. The RAM 113 temporarily stores computation results of the CPU 111, various data and the like. The communication I/F 114 is electrically connected to the input/output I/F 115. The communication I/F 114 is an interface for serial communication, for example. The input/output I/F 114 is connected to the communication I/F 210 of the PC 200.

The drive circuits 116A to 116D are electrically connected to the input/output I/F 115. The drive circuits 116A to 116D are connected to the arm drive motors 121A to 121D. The arm drive motors 121A to 121D are stepping motors. The CPU 111 controls the drive circuits 116A to 116D, and thus drives the arm drive motors 121A to 121D. The arm drive motors 121A to 121D drive the first arm portion 132, the second arm portion 133, and the third arm portion 134 of the movement mechanism 120, and thus move the charging device 135. The arm drive motors 121A to 121D are provided with arm encoders 122A to 122D, on each of an output shaft of the arm drive motor 121A to 121D. The arm encoders 122A to 122D are electrically connected to the input/output I/F 115, respectively. The arm encoders 122A to 122D detect a value corresponding to a rotation angle of the output shaft of each of the arm drive motors 121A to 121D, and output the values to the CPU 111. The CPU 111 computes current positions of the first arm portion 132, the second arm portion 133, and the third arm portion 134 on the basis of the values, and stores the current positions in the RAM 113. By controlling the driving of the arm drive motors 121A to 121D, the CPU 111 moves the charging device 135 between the placement position and the transfer position.

The input/output I/F 115 is electrically connected to a plurality of arm origin sensors 123, and the charging device 135. The plurality of arm origin sensors 123 are provided on rotating shafts of each of the first arm portion 132, the second arm portion 133, and the third arm portion 134 and on an upper end position of the third arm portion 134. The arm origin sensors 123 are used to set a mode of the movement mechanism 120 to a stand-by mode. When the movement mechanism 120 is not operating, the CPU 111 controls driving of each of the arm drive motors 121A to 121D on the basis of detection results of the arm origin sensors 123, and sets the movement mechanism 120 to the stand-by mode. The stand-by mode is a mode that the movement mechanism 120 does not interfere with operations of other devices. The charging device 135 includes a drive circuit and is charged as a result of control by the CPU 111.

The input/output I/F 115 is electrically connected to the imaging device 117, and to electromagnetic valves 118, 151 and 152. When the cloth 105 is adhered to the adhesion surface 136 by the movement mechanism 120 using the charging device 135, the imaging device 117 captures an image of the adhesion surface 136. The CPU 111 analyzes a captured image captured by the imaging device 117, and detects a holding position. The "holding position" is a position in which the charging device 135 holds the cloth 105 with the adhesion surface 136. The CPU 111 sets, in advance, a reference position on the adhesion surface 136. The "reference position" is a position that is a reference for the holding position on the adhesion surface 136, in order to move the cloth 105 accurately to the transfer position. The CPU 111 controls the movement mechanism 120 on the basis of the detection result of the holding position, and, by adjusting any displacement with respect to the reference position, the CPU 111 can accurately move the cloth 105 to the transfer position.

The electromagnetic valve 118 is provided in a feed path of the air fed to the suction valve 145 by the compressor. The CPU 111 opens and closes the electromagnetic valve 118, and thus controls the operation or non-operation of the suction valve 145. The electromagnetic valve 151 is provided in a feed path of the air fed to the air cylinder 162 by the compressor. The CPU 111 opens and closes the electromagnetic valve 151 and controls the pivoting of the support pillar 163 of the cloth clamping device 150, thus moving the clamping mechanism 180 between a position above the cloth box 102 and a position above the placement position. The electromagnetic valve 152 is provided in a feed path of the air fed to the up-and-down movement mechanism 170 by the compressor. The CPU 111 opens and closes the electromagnetic valve 152 and controls the expansion and contraction of the rods 171, thus moving the clamping mechanism 180 up and down.

The PC 200 is provided with a CPU 201. The CPU 201 controls the PC 200. The CPU 201 is connected to a chip set 204, and is electrically connected to a ROM 202, a RAM 203, and a display control portion 208 via the chip set 204. The chip set 204 is a series of circuit groups that manage the transmission and reception of data between the CPU 201, the ROM 202, the RAM 203, and the display control portion 208. The ROM 202 stores a BIOS and the like. The RAM 203 stores various temporary data. The display control portion 208 controls display of images on a display 209.

The chip set 204 is connected to a chip set 205. The CPU 201 is electrically connected to a storage device 206, an input portion 207, and the communication I/F 210, via the chip set 205. The chip set 205 is a series of circuit groups that manage the transmission and reception of data between the CPU 201, the storage device 206, the input portion 207, and the communication I/F 210. The storage device 206 is a non-volatile storage device, such as a HDD, a SSD, or the like. The storage device 206 stores an OS, various applications, data and the like. The input portion 207 is a device for performing an input operation on the PC 200, such as a keyboard, a mouse, or the like. The communication I/F 210 is an interface for serial communication, for example. The communication I/F 210 is connected to the sewing machine 1 (the sewing machines 1A and 1B) and the conveyance device 100 (the conveyance devices 100A and 100B).

Figure 26:
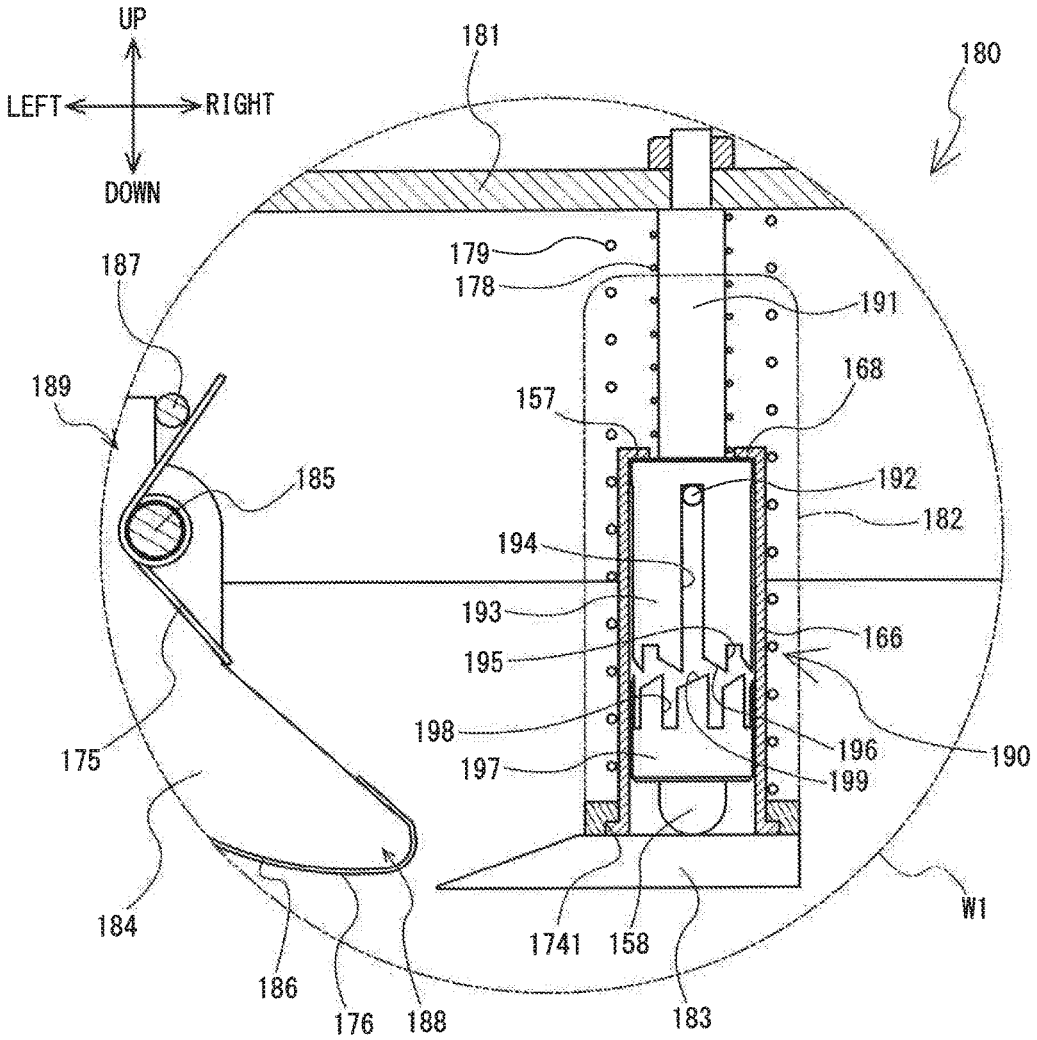
FIG. 26 is a diagram showing an operation of a holding mechanism 190, as a cross-section of part of an enlarged illustration in a circle W1 in FIG. 5.

An operation in which the cloth clamping device 150 clamps the cloth 105 will be explained with reference to FIG. 5, FIG. 10 to FIG. 12, and FIG. 26 to FIG. 30. As shown in FIG. 5, when the cloth clamping device 150 removes the single cloth 105 from the cloths 105 stacked and stored in the cloth box 102, the pivoting mechanism 160 moves the up-and-down movement mechanism 170 and the clamping mechanism 180 to the position above the cloth box 102. The leg portions 182 are positioned in the lower position due to the urging of the compression springs 179, and the clamping portions 184 are positioned in the release position due to the urging of the torsion springs 175. As shown in FIG. 26, the compression spring 179 of the holding mechanism 190 urges the leg portion 182 downward. The compression spring 178 presses the upper surface 157 of the cam member 193 downward. When the pin 192 engages with the guide portion 194 of the cam member 193, the pin 192 moves upward in the guide portion 194 relative to the downward movement of the cam member 193. When the leg portion 182 is positioned in the lower position, the pin 192 is positioned at the upper end of the guide portion 194.

Figure 10:
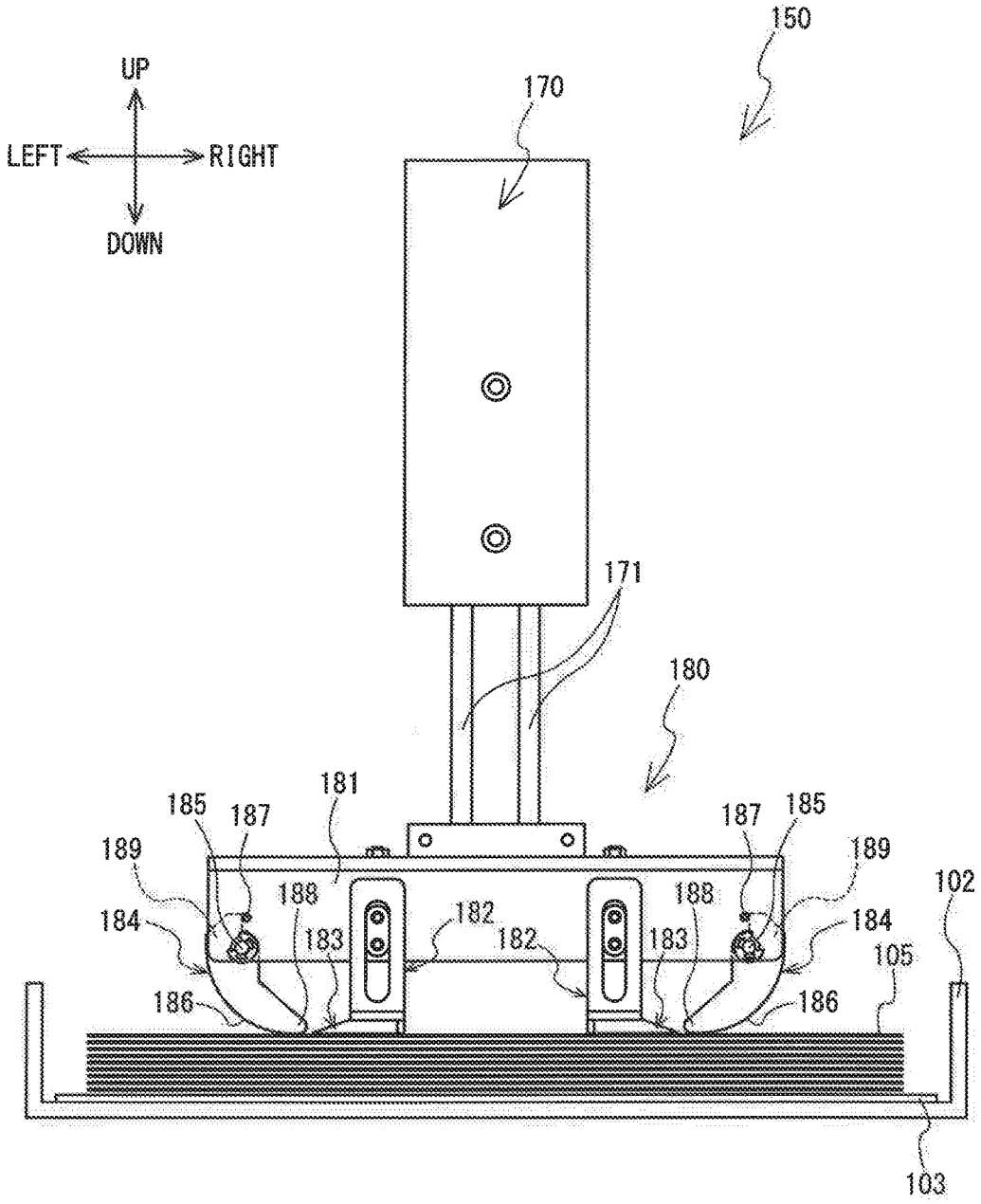
FIG. 10 is a diagram showing a process in which the cloth clamping device 150 clamps a cloth.
Figure 11:
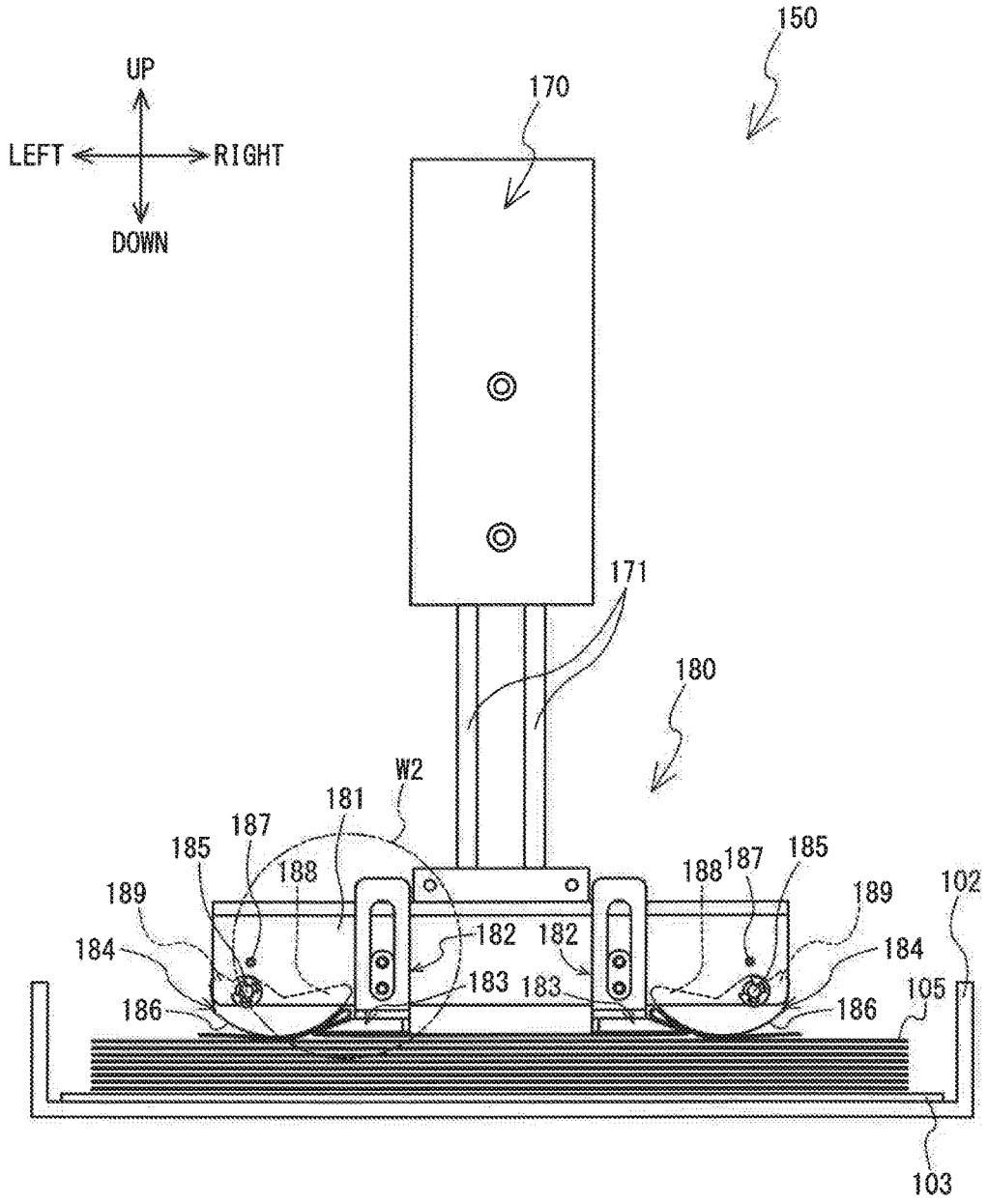
FIG. 11 is a diagram continuing from FIG. 10.

As shown in FIG. 10, the up-and-down movement mechanism 170 extends the rods 171 downward and lowers the clamping mechanism 180 onto the cloth 105. The foot portions 183 come into contact with the uppermost cloth 105, and presses the cloth 105. The support portion 181 lowers and thus, the leg portions 182 move relatively upward. In the course of the leg portions 182 moving toward the upper position from the lower position, the curved surfaces 186 of the clamping portions 184 come into contact with the uppermost cloth 105. With the shaft rods 185 acting as fulcrums, the clamping portions 184 pivot from the open position toward the closed position. The leading end portions 188 move relatively upward with respect to the support portion 181, while approaching the leg portions 182. Positions at which the curved surfaces 186 come into contact with the cloth 105 move from the side of the leading end portions 188 toward the side of the base end portions 189, in accordance with the pivoting of the clamping portions 184. The pads 176 draw up the cloth 105 that is in contact with the curved surfaces 186 toward the leading end portions 188. The frictional force of the pads 176 is larger than the frictional force between the cloths 105. Thus, the clamping portions 184 only draw up the uppermost cloth 105. The leading end portions 188 face the foot portions 183. As a result, the clamping portions 184 convey the sections of the cloth 105 in contact with the curved surfaces 186 toward the foot portions 183. When the clamping portions 184 pivot to the closed position, the leading end portions 188 are positioned above the foot portions 183. As shown in FIG. 11, when the leg portions 182 are positioned in the upper position, the sections of the cloth 105 drawn in by the pads 176 are bent into a substantially S shape. The clamping portions 184 and the foot portions 183 clasp the bent sections of the cloth 105 from above and below.

Figure 27:
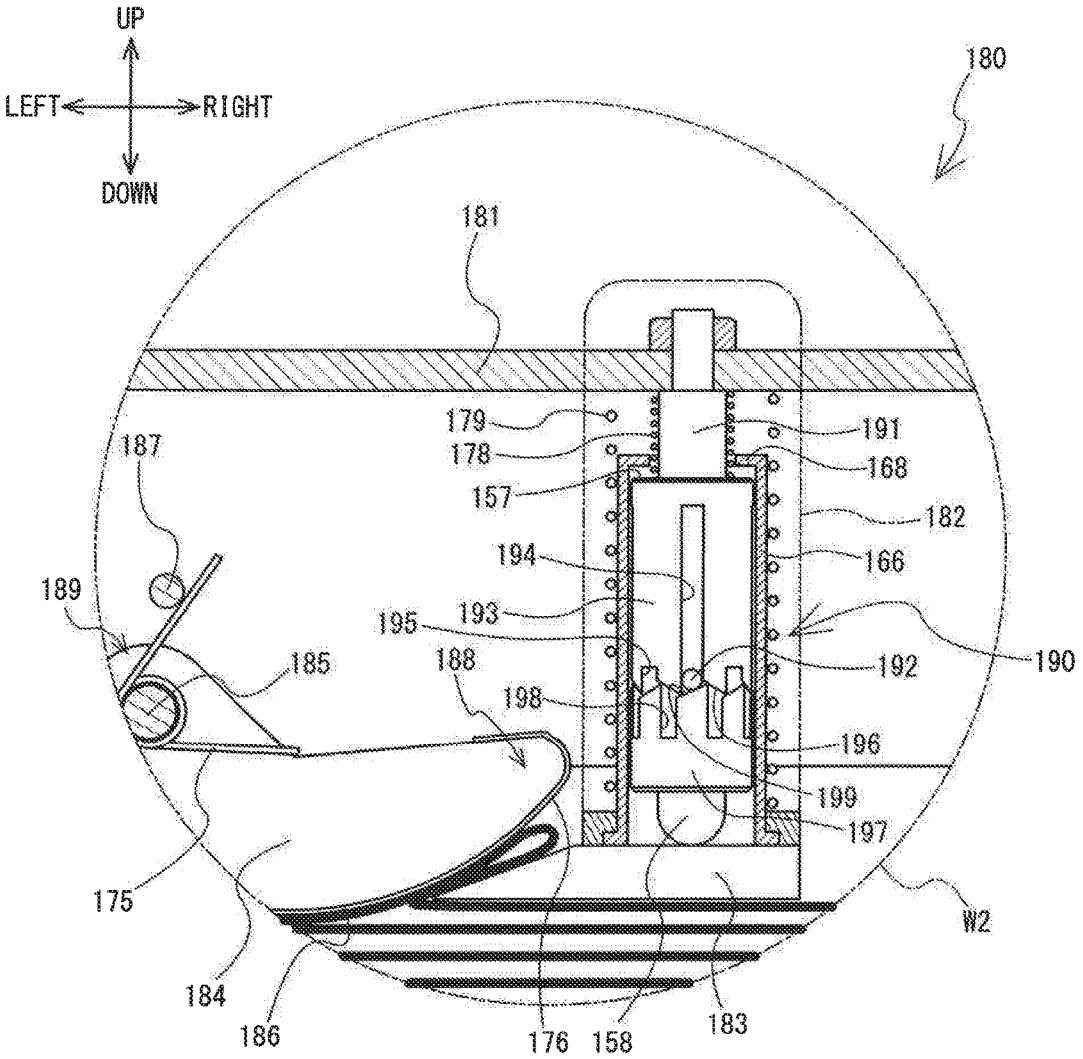
FIG. 27 is a diagram showing an operation of the holding mechanism 190, as a cross-section of part of an enlarged illustration in a circle W2 in FIG. 11.

As shown in FIG. 27, when the leg portion 182 moves from the lower position toward the upper position, as a result of the pressing of the switching member 197 that comes into contact with the foot portion 183, the cam member 193 resists the urging force of the compression spring 178 and moves upward relative to the pin 192. Lower end portions of the cam member 193 come into contact with the inclined surfaces 199 of the switching member 197. The pin 192 moves relatively downward along the guide portion 194, and moves from the upper end to the lower end of the guide portion 194. The pin 192 comes into contact with the inclined surface 199 of the switching member 197, and presses the inclined surface 199 relatively downward.

Figure 28:
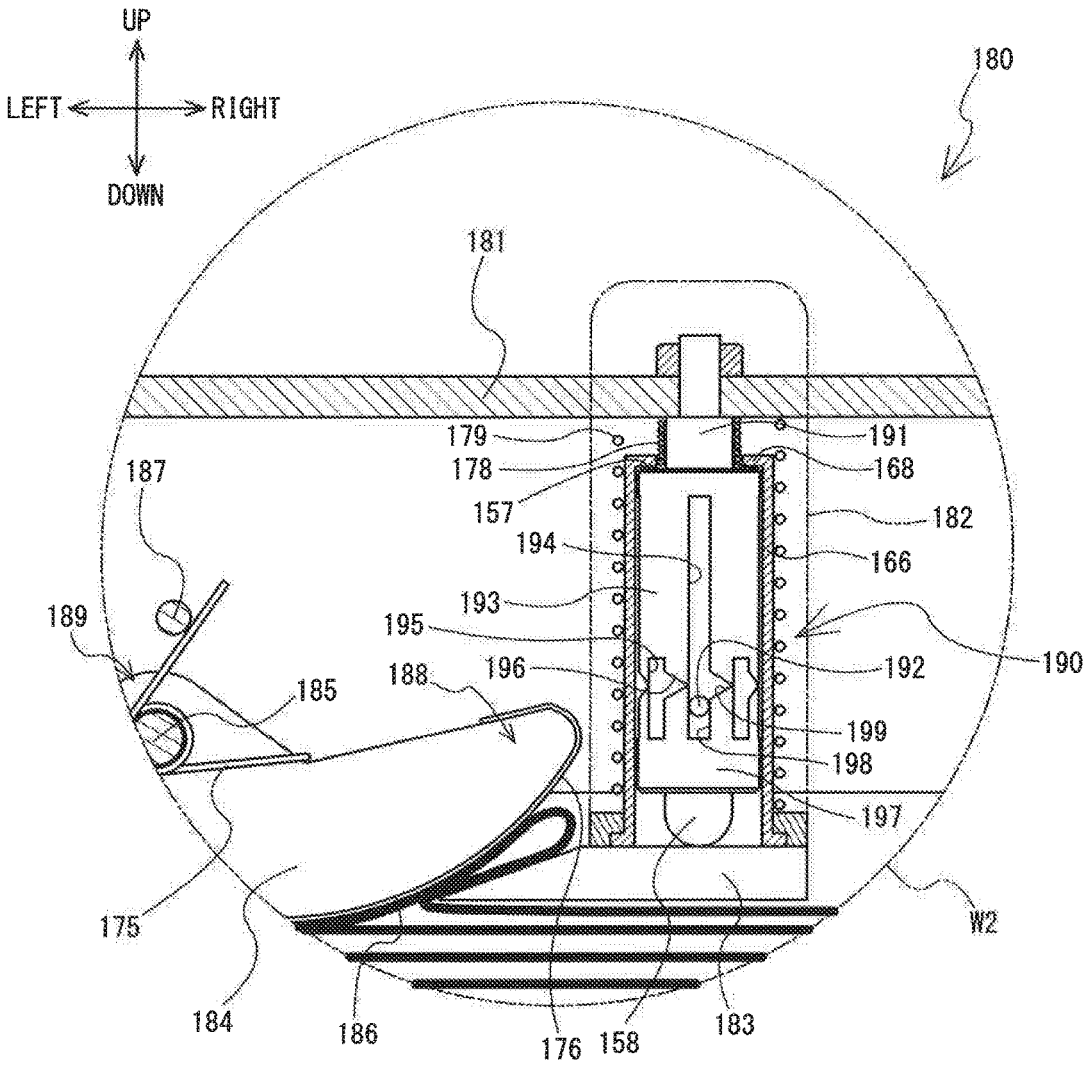
FIG. 28 is a diagram continuing from FIG. 27.

As shown in FIG. 28, as a result of the force of the pin 192 pressing the inclined surface 199, the switching member 197 rotates in the counterclockwise direction in a plan view, around the shaft portion 158. Due to the rotation of the switching member 197, the groove portion 198 moves to a position below the pin 192. The pin 192 moves relatively downward and moves inside the groove 198.

Figure 29:
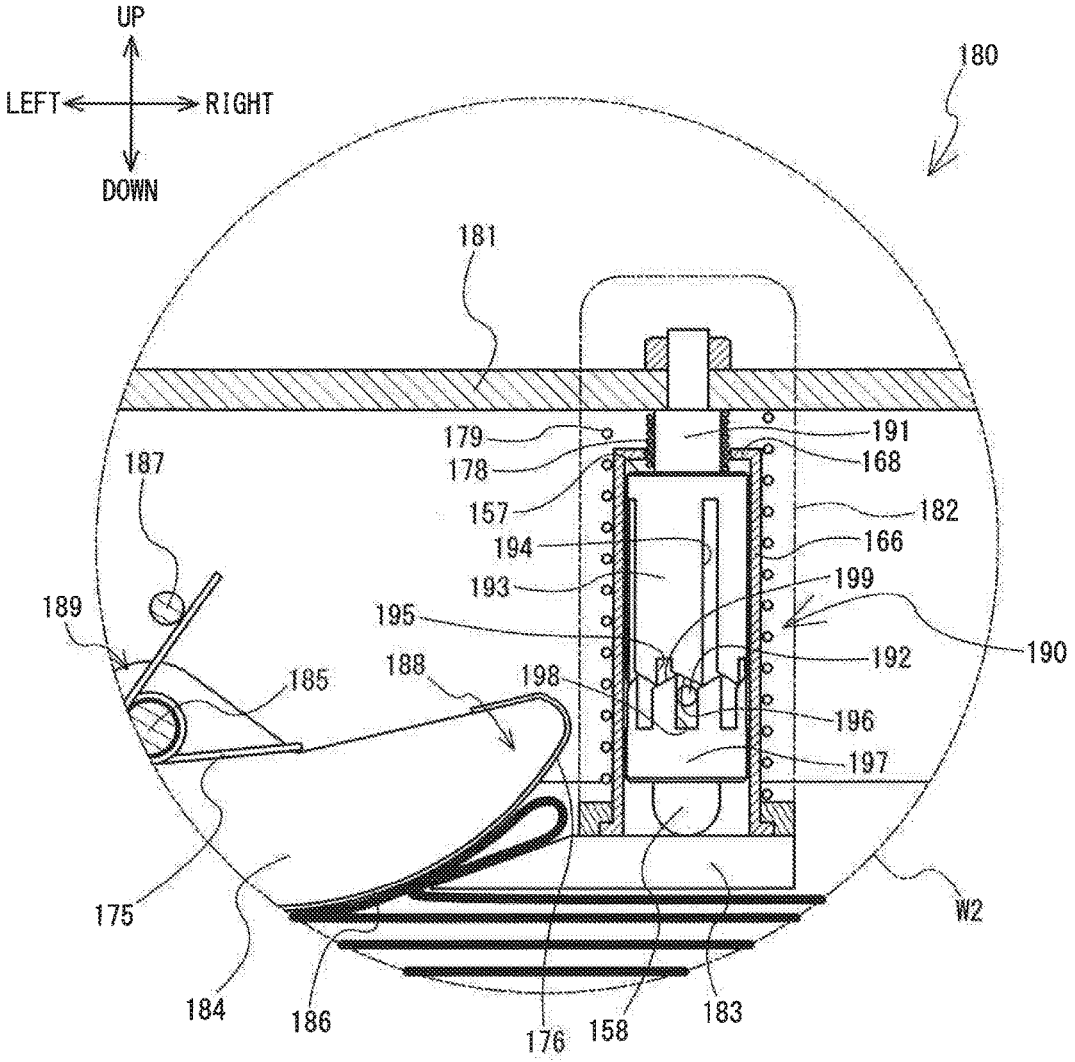
FIG. 29 is a diagram continuing from FIG. 28.

As shown in FIG. 29, the engagement between the pin 192 and the cam member 193 is released, and the cam member 193 is enabled to rotate. The pin 192 engages with the switching member 197, and stops the rotation of the switching member 197. The upper ends of the inclined surfaces 199 of the switching member 197 relatively move along the inclined surfaces 196 of the cam member 193, and the cam member 193 rotates. The cam member 193 rotates in the counterclockwise direction in a plan view, around the support rod 191, and the inclined surfaces 196 move to positions above the groove portions 198.

Figure 12:
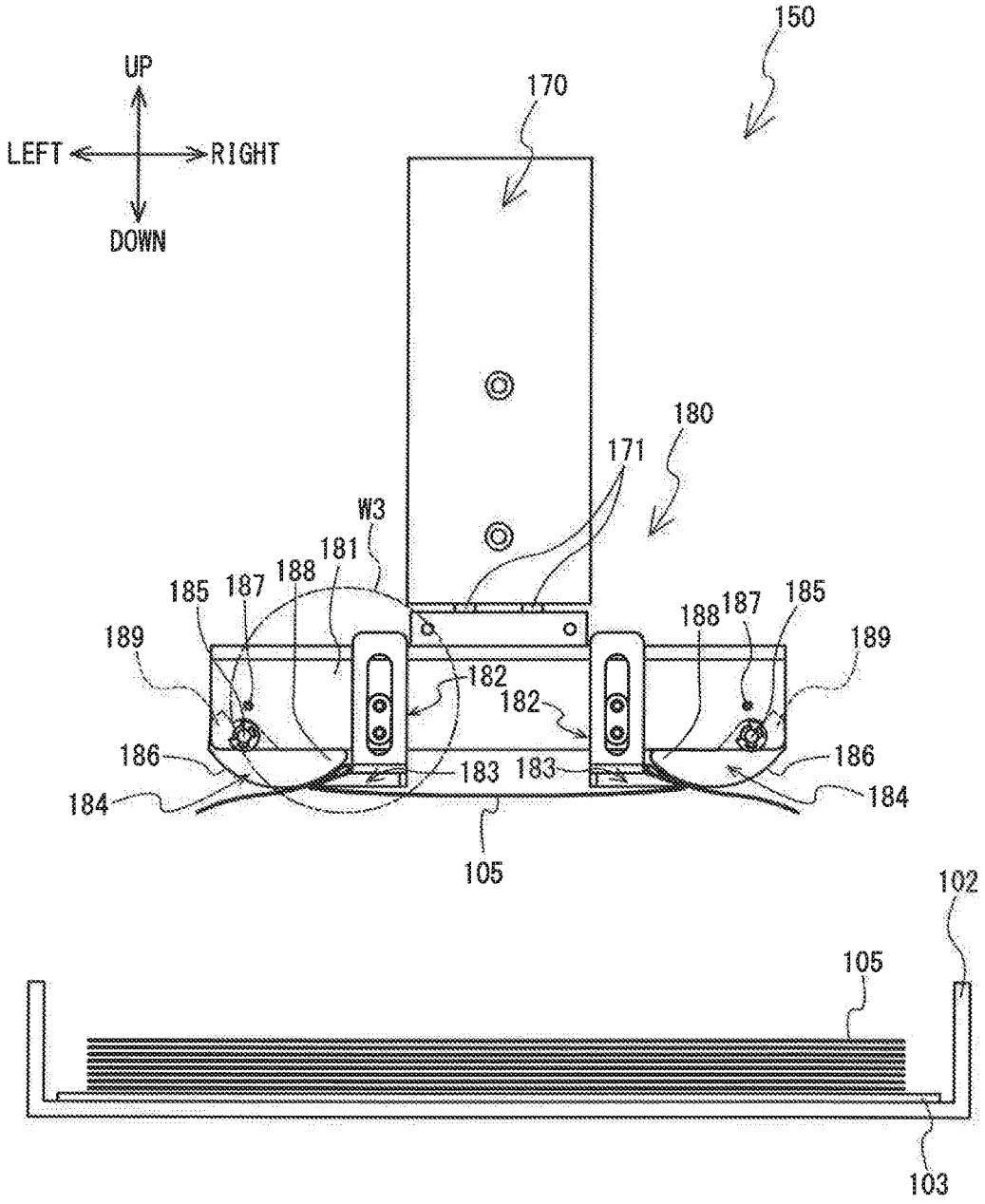
FIG. 12 is a diagram continuing from FIG. 11.

As shown in FIG. 12, the up-and-down movement mechanism 170 contracts the rods 171 upward, and thus raises the clamping mechanism 180. When the support portion 181 rises up and the foot portions 183 release the relative upward pressing of the leg portions 182, the compression springs 179 press the leg portions 182 downward. The compression springs 178 press the cam members 193 downward, and the cam members 193 move relatively downward with respect to the pins 192. The pins 192 move relatively upward along the groove portions 198, and come into contact with the inclined surfaces 196 of the cam members 193. The pins 192 press the inclined surfaces 196 relatively upward.

Figure 30:
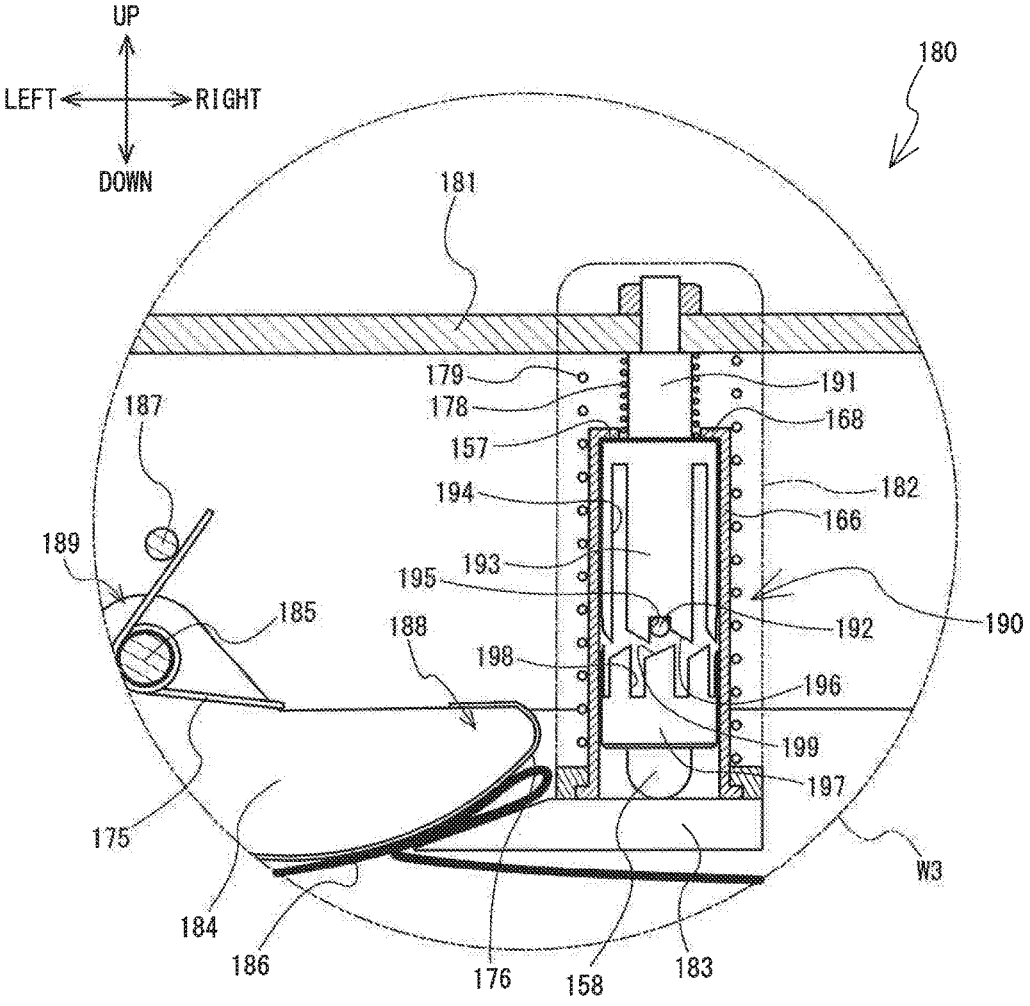
FIG. 30 is a diagram showing an operation of the holding mechanism 190, as a cross-section of part of an enlarged illustration in a circle W3 in FIG. 12.

As shown in FIG. 30, as a result of the force of the pin 192 pressing the inclined surface 196, the cam member 193 rotates in the counterclockwise direction in a plan view, around the support rod 191. Due to the rotation of the cam member 193, the restricting portion 195 aligned adjacent to the guide portion 194 moves to a position above the pin 192. The pin 192 moves relatively upward and moves inside the restricting portion 195, and is positioned at the upper end of the restricting portion 195. The restricting portion 195 restricts the relative downward movement of the cam member 193 with respect to the pin 192. The leg portion 182 that is integrated with the protective tube 166 attempts to move downward due to the urging of the compression spring 179. The upper surface 157 of the cam member 193 comes into contact with the lower surface of the upper wall 168 of the protective tube 166, and restricts the downward movement of the leg portion 182. As a result of the above operations, the holding mechanism 190 holds the leg portion 182 in the upper position.

The clamping mechanism 180 maintains the state in which the single cloth 105 is clamped by the clamping portions 184 and the foot portions 183. The pivoting mechanism 160 moves the up-and-down movement mechanism 170 and the clamping mechanism 180 to a position above the placement position, and the up-and-down movement mechanism 170 lowers the clamping mechanism 180. When the foot portions 183 come into contact with the upper surface of the accessory plate 5 at the placement position and move the leg portions 182 relatively upward with respect to the support portion 181, the cam members 193 and the switching members 197 operate in concert with each other as described above so as to move the pins 192 from the restricting portions 195 to the guide portions 194. The holding mechanism 190 releases the hold of the leg portions 182. When the up-and-down movement mechanism 170 raises the clamping mechanism 180, the leg portions 182 move from the upper position to the lower position due to the urging force of the compression springs 179, and the clamping portions 184 pivot from the closed position to the open position due to the urging force of the torsion springs 175. As a result, the cloth clamping device 150 releases the clamping of the cloth 105 by the clamping portions 184 and the foot portions 183, and can place the single cloth 105 at the placement position.

In the following explanation, when the respective positions of the sewing machine 1A and the conveyance device 100A and the respective positions of the sewing machine 1B and the conveyance device 100B are explained so as to be distinguished from each other, for convenience, the respective positions of the sewing machine 1A and the conveyance device 100A will be referred to as positions A, and the respective positions of the sewing machine 1B and the conveyance device 100B will be referred to as positions B. The cloth 105 removed by the conveyance device 100A from the cloth box 102A and sewn by the sewing machine 1A is referred to as the cloth 105A, and the cloth 105 removed by the conveyance device 100B from the cloth box 102B is referred to as the cloth 105B. The sewing machine 1B sews the cloth 105A and the cloth 105B that are overlaid with each other.

Figure 15:
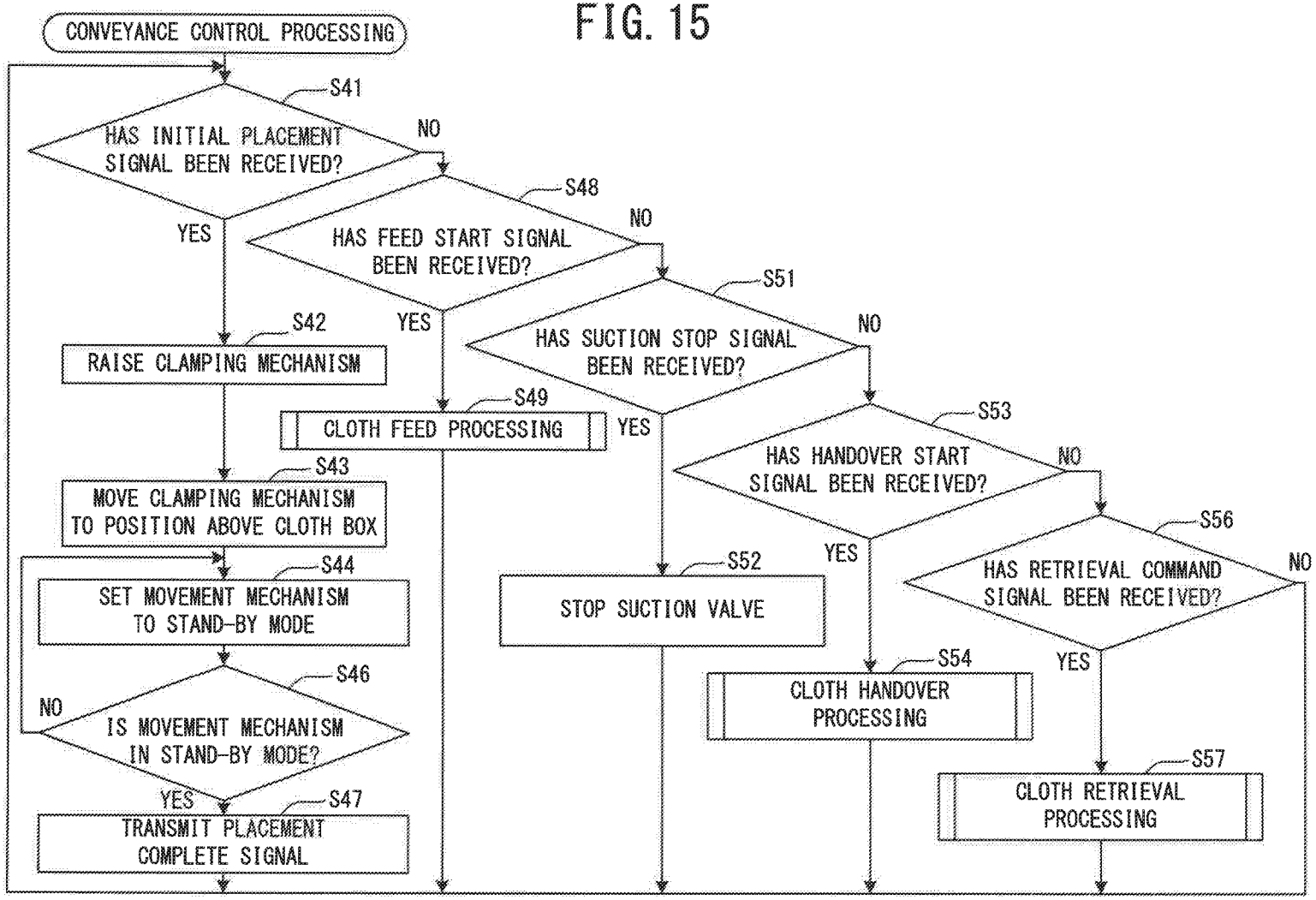
FIG. 15 is a flowchart of conveyance control processing.
Figure 19:
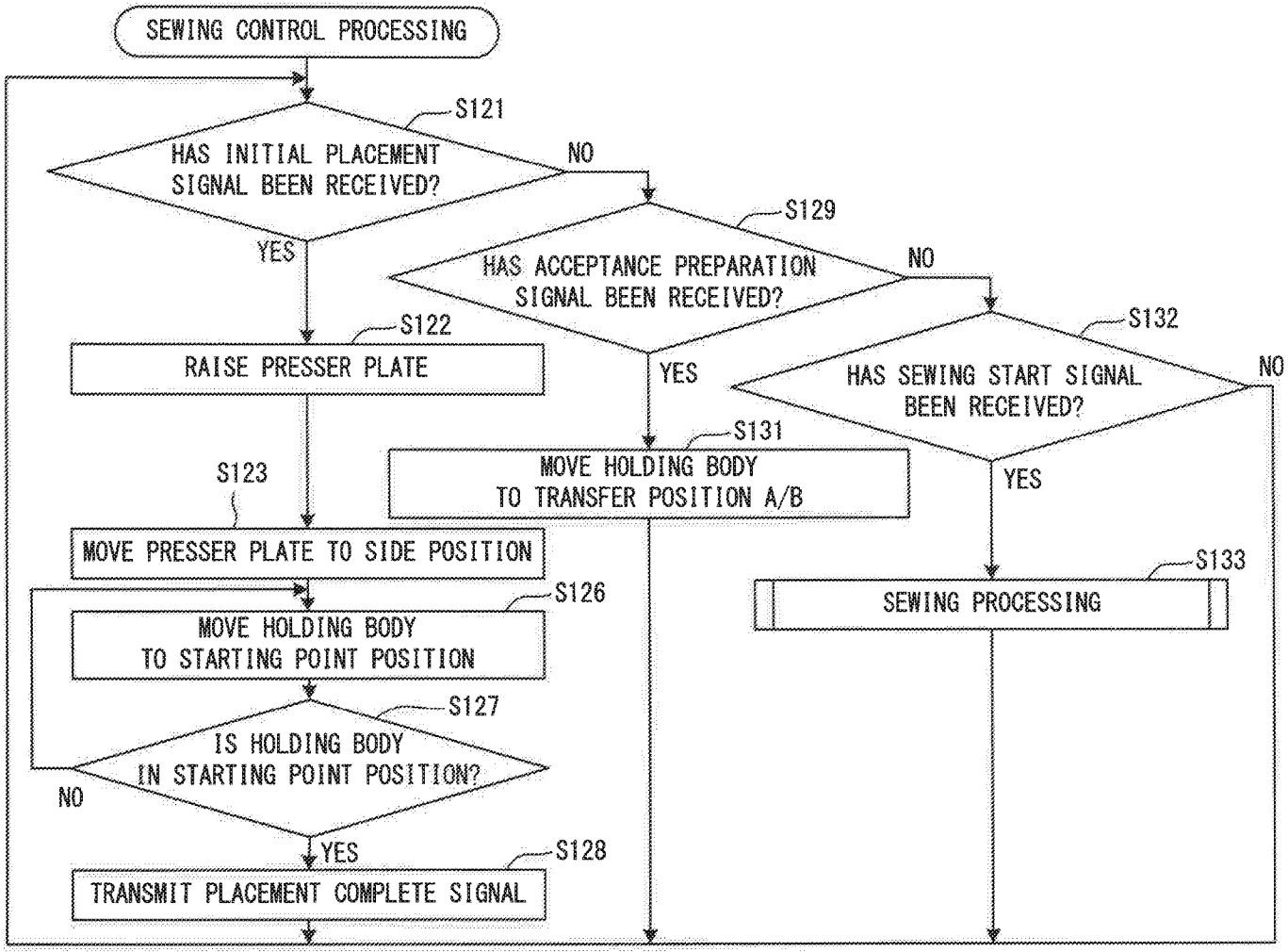
FIG. 19 is a flowchart of sewing control processing.

In the conveyance system 300, the CPU 201 of the PC 200 executes system control processing programs stored in the storage device 206, controls the operations of the sewing machines 1 and the conveyance devices 100 and performs a series of processing to perform sewing on the cloths 105. As shown in FIG. 15, when the operator switches on the power source of each of the conveyance devices 100, the CPU 111 reads out a program for conveyance control processing from the ROM 112 and executes the program. The CPU 111 stands by to receive various command signals from the PC 200 (no at step S41; no at step S48; no at step S51; no at step S53; no at step S56; step S41). As shown in FIG. 19, when the operator switches on the power source of each of the sewing machines 1, the CPU 51 reads out a program for sewing control processing from the ROM 52 and executes the program. The CPU 51 stands by to receive various command signals transmitted by the PC 200 (no at step S121; no at step S129; no at step S132; step S121).

Figure 13:
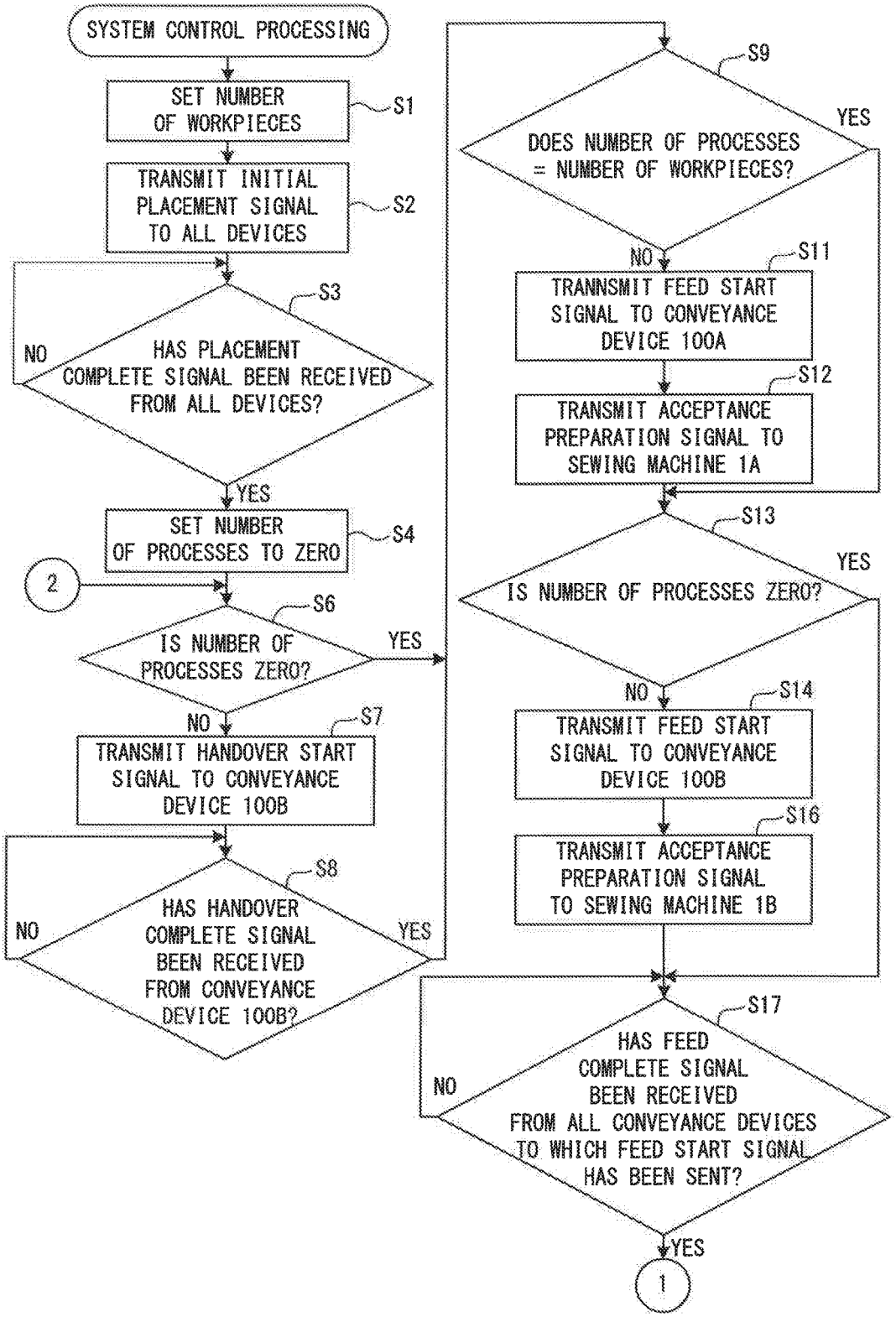
FIG. 13 is a flowchart of system control processing.

As shown in FIG. 13, when the operator switches on the power source of the PC 200, the CPU 201 starts up the BIOS stored in the ROM 202, reads in the OS stored in the storage device 206, and runs the OS. When the operator operates the PC 200 and enters a command to execute the system control processing, the CPU 201 reads out the system control processing program from the storage device 206, and executes the program.

The CPU 201 receives an input of a number of workpieces through an operation by the operator. The number of workpieces is a number of objects to be sewn, on which the sewing is carried out. The operator stacks and stores, in advance, a number of the cloths 105A and 105B corresponding to the number of workpieces, in the cloth boxes 102A and 102B, respectively. The CPU 201 stores the number of workpieces input by the operator in the RAM 203, and sets the number of workpieces (step S1). The CPU 201 transmits an initial placement signal to all of the devices (the sewing machines 1A and 1B, and the conveyance devices 100A and 100B) (step S2), and stands by until it receives a placement complete signal from all the devices (no at step S3).

As shown in FIG. 15, when the CPUs 111 of the conveyance devices 100A and 100B receive the initial placement signal (yes at step S41), the CPUs 111 advance the processing to step S42. The CPUs 111 drive the up-and-down movement mechanisms 170 by operating the electromagnetic valves 152, and pull the rods 171 upward. The clamping mechanism 180 of each of the cloth clamping devices 150A, 150B and 150C rises (step S42). The CPUs 111 drive the air cylinders 162 by operating the electromagnetic valves 151, and pivot the support pillars 163 in the counterclockwise direction in a plan view. The up-and-down movement mechanism 170 and the clamping mechanism 180 of each of the cloth clamping devices 150A, 150B and 150C move to positions above the cloth boxes 102A, 102B and 102C (step S43). Each of the CPUs 111 drives the movement mechanism 120 and performs processing to set the stand-by mode (step S44). Based on the value of the arm encoders 122A to 122D and on the detection results of the arm origin sensor 123, the CPU 111 controls the plurality of arm drive motors 121A to 121D until the movement mechanism 120 enters the stand-by mode (no at step S46; step S44). When the movement mechanism 120 enters the stand-by mode (yes at step S46), the CPU 111 transmits the placement complete signal to the PC 200 (step S47). The CPU 111 returns the processing to step S41, and stands by to receive various command signals from the PC 200.

As shown in FIG. 19, when the CPUs 51 of the sewing machines 1A and 1B receive the initial placement signal (yes at step S121), the CPUs 51 advance the processing to step S122. The CPUs 51 drive the air cylinders 69 by operating the electromagnetic valves 38, and raise the holding bodies 70 via the raising/lowering levers (step S122). The presser plates 74 of the holding bodies 70 rise, and are separated from the upper surface of the accessory plate 5. The CPUs 51 drive the air cylinders 72 by operating the electromagnetic valves 39, and cause the presser feet 73 to move to the left of the raising/lowering plates 71. The presser plates 74 move to the side positions (step S123). The CPUs 51 drive the horizontal movement mechanisms 6 and move the holding bodies 70 to their respective origin positions (step S126). Based on the respective values of the X-axis encoders 33 and the Y-axis encoders 35 and on the respective detection results of the X-direction origin sensors 36 and the Y-direction origin sensors 37, the CPUs 51 control the driving of the X-axis motors 32 and the Y-axis motors 34 until the holding bodies 70 move to the origin positions (no at step S127; step S126). When the holding bodies 70 move to the origin positions (yes at step S127), the CPUs 51 transmit the placement complete signal to the PC 200 (step S128). The CPUs 51 return the processing to step S121, and stand by to receive various command signals from the PC 200.

As shown in FIG. 13, when the CPU 201 of the PC 200 receives the placement complete signal from all of the devices (yes at step S3), the CPU 201 sets zero as a number of processes and stores this number of processes in the RAM 203 (step S4). The CPU 201 counts, as the number of processes, a number of times that a series of processing is repeated by all of the devices, and performs control of each of the devices accordingly. When the number of processes is not zero, the CPU 201 advances the processing to step S7 (no at step S6), and when the number of processes is zero, the CPU 201 advances the processing to step S9 (yes at step S6). Here, the CPU 201 advances the processing to step S9 because the number of processes has been set to zero at step S4. When the number of processes and the number of workpieces differ from each other, the CPU 201 advances the processing to step S11 (no at step S9), and when the number of processes and the number of workpieces are the same, the CPU 201 advances the processing to step S13 (yes at step S9). When, at step S9, the number of processes is zero, the CPU 201 transmits a feed start signal to the conveyance device 100A (step S11), and transmits an acceptance preparation signal to the sewing machine 1A (step S12). The CPU 201 advances the processing to step S13.

Figure 16:
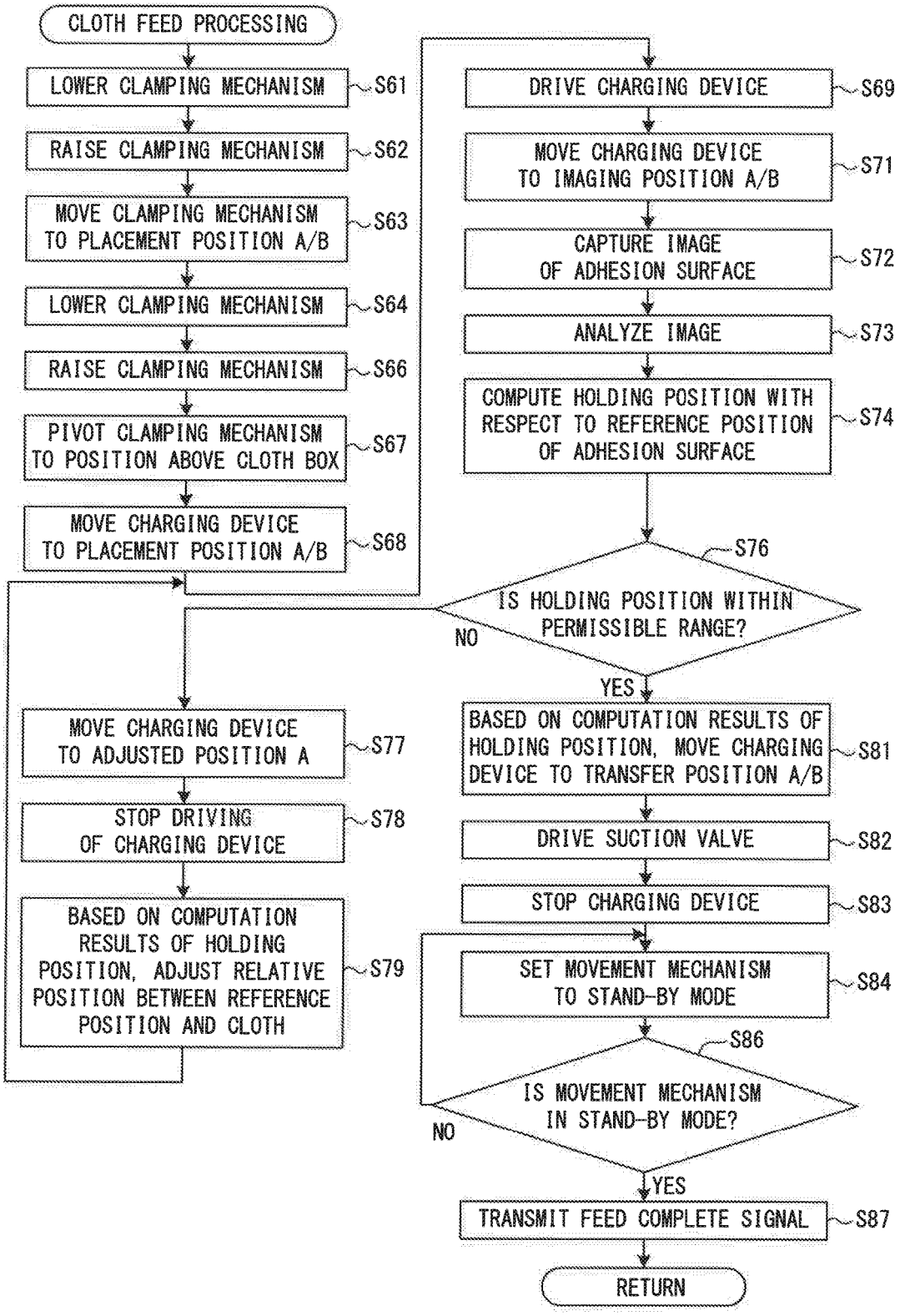
FIG. 16 is a flowchart of cloth feed processing.

As shown in FIG. 15, when the CPU 111 of the conveyance device 100A receives the feed start signal (yes at step S48), the CPU 111 performs cloth feed processing (step S49). As shown in FIG. 16, the CPU 111 operates the electromagnetic valve 152, thus driving the up-and-down movement mechanism 170 of the cloth clamping device 150A, and lowers the clamping mechanism 180 inside the cloth box 102A (step S61). The foot portions 183 and the clamping portions 184 of the clamping mechanism 180 come into contact with the uppermost cloth 105A inside the cloth box 102A, and the cloth 105A is clasped between the clamping portions 184 and the foot portions 183. The CPU 111 operates the electromagnetic valve 152, thus driving the up-and-down movement mechanism 170, and raises the clamping mechanism 180 (step S62). When the leg portions 182 move to the upper position, the holding mechanism 190 operates, and the clamping mechanism 180 maintains the state of clamping the cloth 105A and rises above the cloth box 102A. The CPU 111 operates the electromagnetic valve 151, thus driving the air cylinder 162, and pivots the support pillar 163 by substantially 90 degrees in the clockwise direction in a plan view. The up-and-down movement mechanism 170 and the clamping mechanism 180 move to a position above a placement position A (step S63).

The CPU 111 operates the electromagnetic valve 152, thus driving the up-and-down movement mechanism 170, and lowers the clamping mechanism 180 toward the placement position A (step S64). When the foot portions 183 come into contact with the upper surface of the accessory plate 5 at the placement position A and the leg portions 182 are subject to the upward pressing force, the holding mechanism 190 releases the hold of the leg portions 182. The CPU 111 operates the electromagnetic valve 152, thus driving the up-and-down movement mechanism 170, and raises the clamping mechanism 180 (step S66). The clamping mechanism 180 releases the clamping of the cloth 105A, and rises above the placement position A. The cloth 105A remains on the placement position A (refer to FIG. 21), in a state of having been rotated by substantially 90 degrees in the clockwise direction with respect to the orientation of the cloth 105A when stored inside the cloth box 102A. The CPU 111 operates the electromagnetic valve 151, thus driving the air cylinder 162, and pivots the support pillar 163 by substantially 90 degrees in the counterclockwise direction in a plan view. The up-and-down movement mechanism 170 and the clamping mechanism 180 pivot to the position above the cloth box 102A (step S67).

The CPU 111 drives the arm drive motors 121A to 121D of the movement mechanism 120A and moves the charging device 135 to the placement position A (step S68). The CPU 111 controls the movement mechanism 120A in accordance with a program prepared in advance, and moves the charging device 135 to a predetermined position of the placement position A. When moving the charging device 135 to the placement position A, the CPU 111 rotates the third arm portion 134 of the movement mechanism 120A. As shown by one-dot chain lines in FIG. 21, the charging device 135 is positioned at the placement position A with an orientation of having been rotated by substantially 90 degrees in a plan view with respect to the orientation of the charging device 135 in the stand-by mode (refer to FIG. 4).

Figure 21:
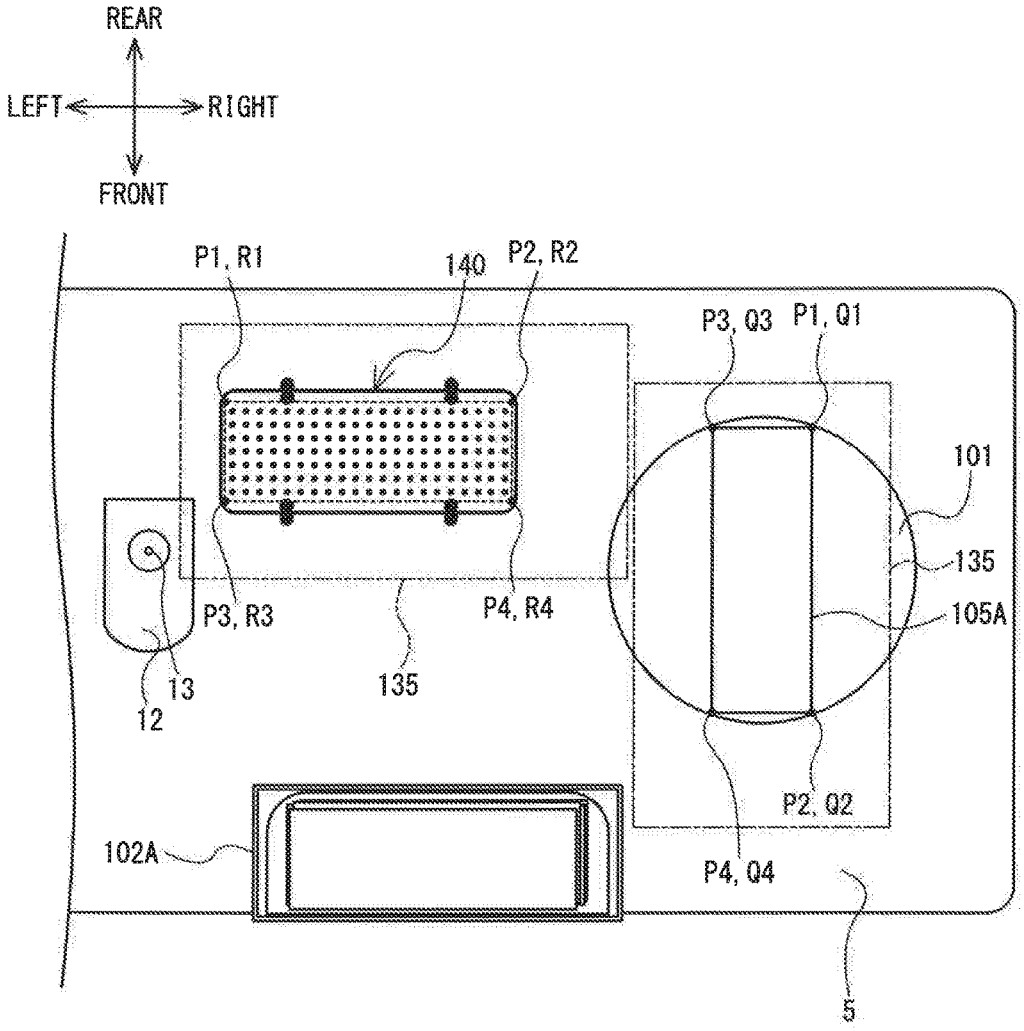
FIG. 21 is a diagram showing an operation of a charging device 135 for moving a cloth 105A from a placement position to a transfer position when a holding position is aligned with a reference position.

The CPU 111 drives the charging device 135 (step S69). The charging device 135 becomes electrostatically charged, and causes the cloth 105A at the placement position A to adhere to the adhesion surface 136. The CPU 111 drives the arm drive motors 121A to 121D of the movement mechanism 120A and moves the charging device 135 to an imaging position A (step S71). The CPU 111 captures the image of the adhesion surface 136 using the imaging device 117, and saves the captured image in the RAM 113 (step S72). The CPU 111 analyzes the captured image (step S73). For example, the CPU 111 uses a template image of the adhesion surface 136 and the cloth 105A prepared in advance, and performs known matching processing on the captured image. As shown in FIG. 21, based on four corner positions of the adhesion surface 136 and the cloth 105A of the template image, the CPU 111 sets a reference position indicated by a rectangular area encompassed by points P1 to P4 corresponding to the four corner positions of the cloth 105A, and sets a coordinate system in which the point P1 is an origin, for example. The CPU 111 detects, as a holding position, a rectangular area encompassed by points Q1 to Q4 indicating positions of the four corners of the cloth 105A in the captured image.

As shown in FIG. 16, the CPU 111 computes relative position coordinates and a relative rotation angle of the holding position with respect to the reference position (step S74). Specifically, based on the relative position coordinates of the points Q1 and Q2 with respect to the points P1 and P2, the CPU 111 calculates a distance between the point P1 and the point Q1, and an angle of a line segment Q1 to Q2 with respect to a line segment P1 to P2. When the distance between the point P1 and the point Q1 is equal to or less than a predetermined distance, and the angle of the line segment P1 to P2 with respect to the line segment Q1 to Q2 is within a predetermined rotation range, the CPU 111 determines that the holding position is within a permissible range. When the holding position is within the permissible range (yes at step S76), based on the computation results of the holding position, the CPU 111 drives the arm drive motors 121A to 121D of the movement mechanism 120A and moves the charging device 135 to a transfer position A (step S81). As shown in FIG. 21, for example, the holding position (the points Q1 to Q4) sometimes matches the reference position (the points P1 to P4). At this time, the CPU 111 controls the movement mechanism 120A such that the points P1 to P4 indicating the reference position overlap with points R1 to R4 set in the transfer position A, and moves the charging device 135 to the position shown by two-dot chain lines. The CPU 111 advances the processing to step S82.

Figure 22:
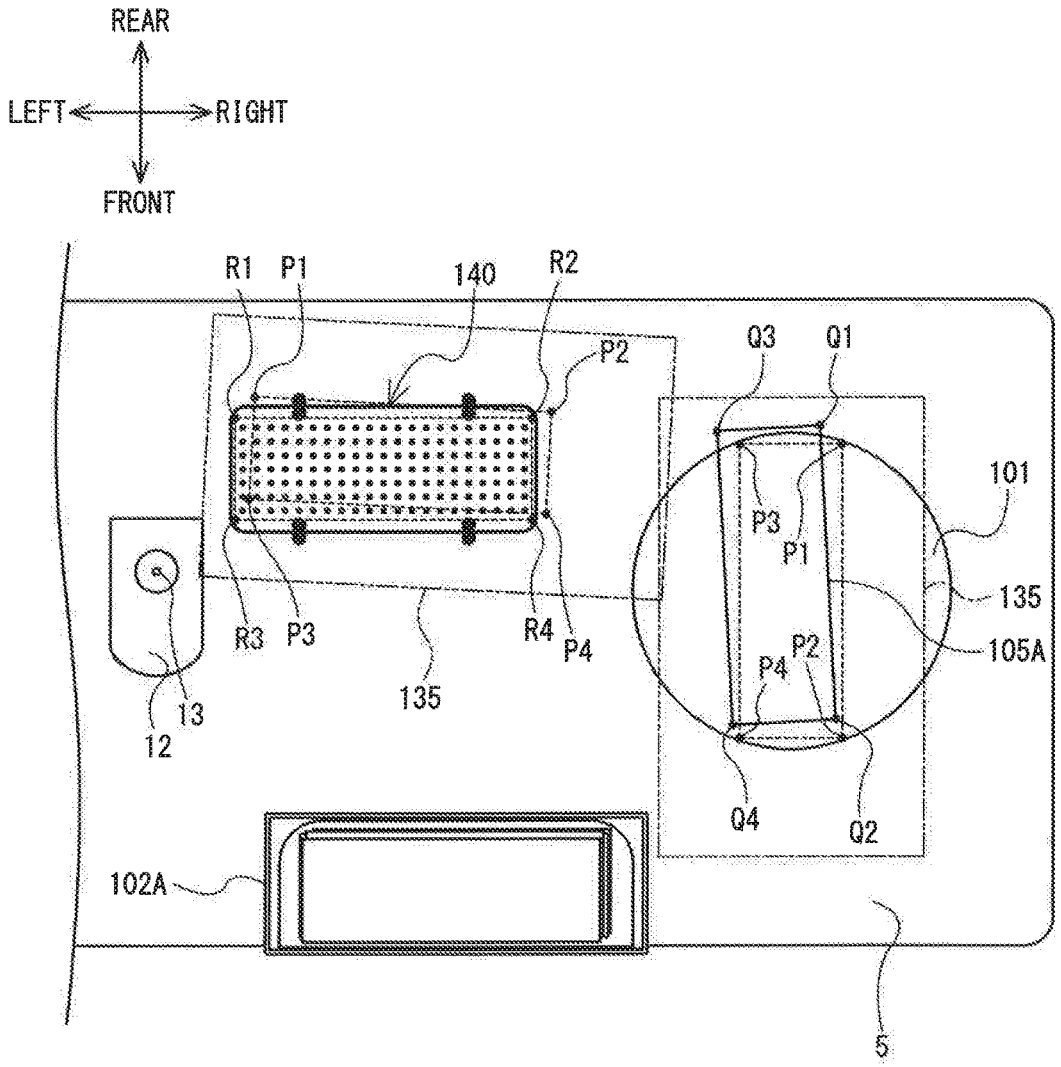
FIG. 22 is a diagram showing an operation of the charging device 135 for moving the cloth 105A from the placement position to the transfer position when the holding position is within a permissible range.

As shown in FIG. 22, for example, sometimes the holding position (the points Q1 to Q4) is out from the reference position (the points P1 to P4), but is within the permissible range. At this time, the CPU 111 adjusts a position of a movement destination of the charging device 135 in accordance with the computation results of step S74, such that the points Q1 to Q4 indicating the holding position overlap with the points R1 to R4 set in the transfer position A. The charging device 135 moves to the position indicated by the two-dot chain lines, and the CPU 111 advances the processing to step S82.

As shown in FIG. 16, when the holding position is not within the permissible range (no at step S76), the CPU 111 drives the arm drive motors 121A to 121D of the movement mechanism 120A, and moves the charging device 135 to an adjusted position A (step S77). The "adjusted position" is a position on the accessory plate 5 at which the cloth 105A can be placed without any interference between the charging device 135 and the cloth box 102A, or the needle bar 10 positioned above the needle hole 13 and so on, even when the charging device 135 is holding the cloth 105A in any position of the adhesion surface 136. The adjusted position A of the present embodiment is within an area encompassed by the cloth box 102A, the needle plate 12, the suction mechanism 140, and the window portion 101, in a plan view.

Figure 23:
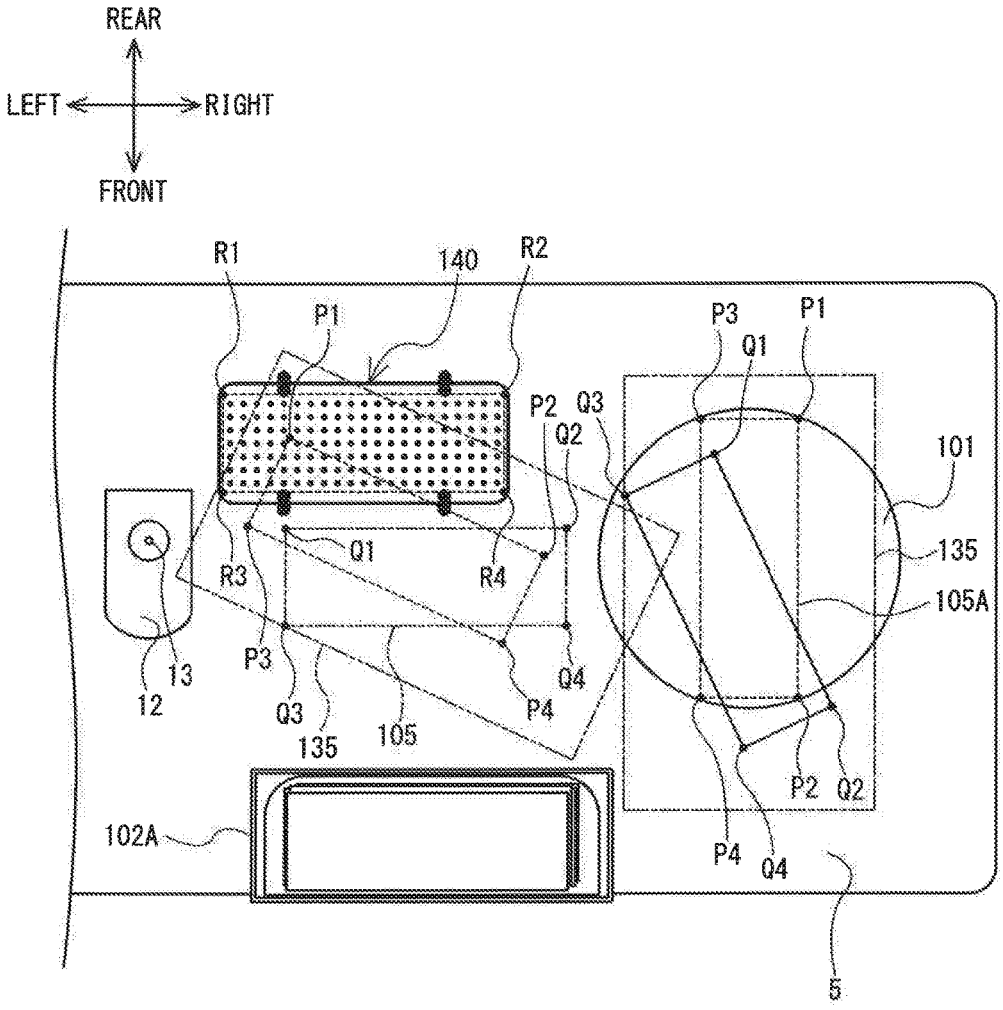
FIG. 23 is a diagram showing an operation of the charging device 135 for moving the cloth 105A from the placement position to an adjustment position when the holding position is not within the permissible range.
Figure 24:
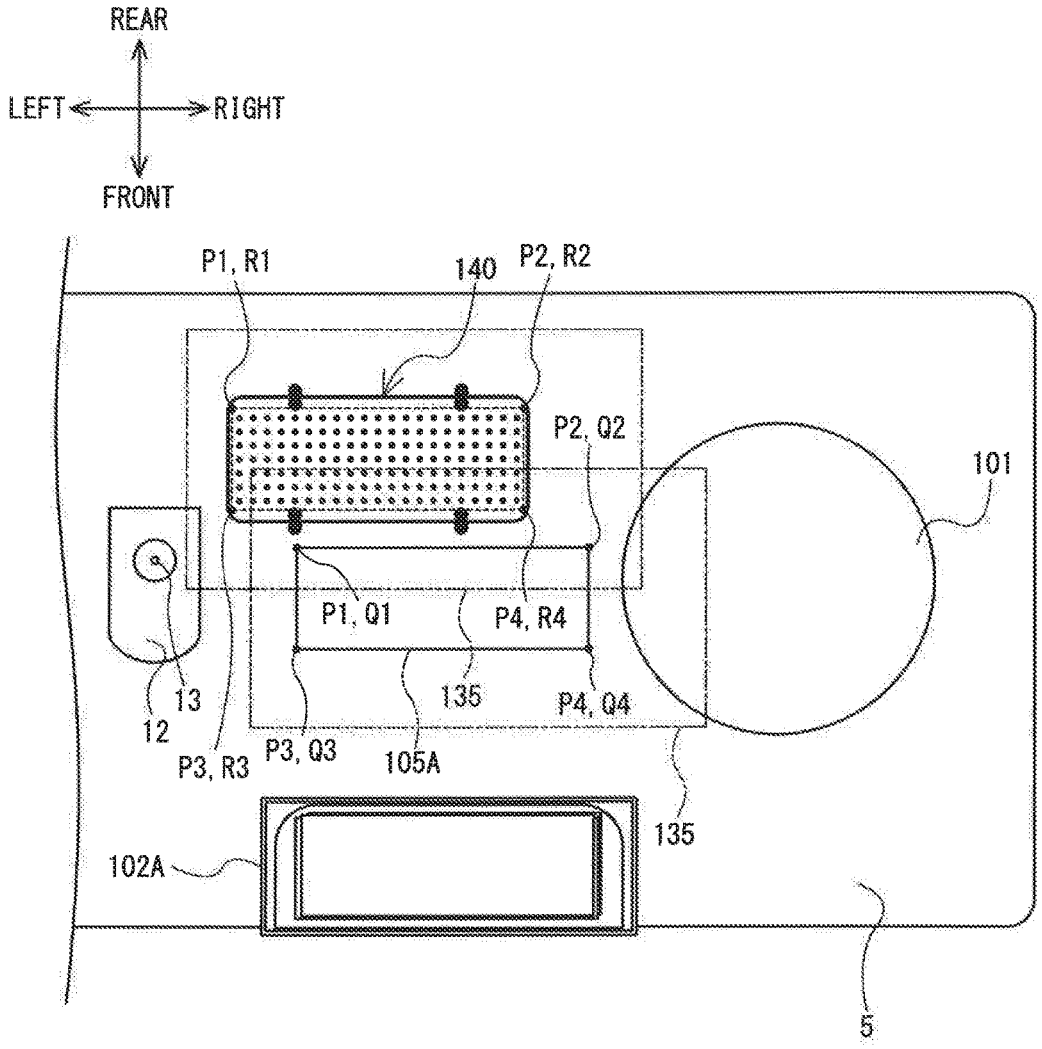
FIG. 24 is a diagram showing an operation of the charging device 135 for moving the cloth 105A from the adjustment position to the transfer position when the holding position is not within the permissible range.

As shown in FIG. 23, based on the computation results of the holding position, the CPU 111 moves the charging device 135 to a position indicated by two-dot chain lines. As shown in FIG. 16, the CPU 111 stops the driving of the charging device 135 (step S78). The charging device 135 releases the adhesion of the cloth 105A to the adhesion surface 136, and places the cloth 105A in the adjusted position A. Based on the computation results of the holding position, the CPU 111 adjusts the relative position between the reference position and the cloth 105A in the adjusted position A (step S79). As shown in FIG. 24, the CPU 111 drives the arm drive motors 121A to 121D of the movement mechanism 120A based on the computation results of the holding position, and moves the charging device 135. The charging device 135 moves to a position indicated by one-dot chain lines, such that the points P1 to P4 indicating the reference position overlap with the points Q1 to Q4 indicating the positions of the four corners of the cloth 105A placed in the adjusted position A.

As shown in FIG. 16, the CPU 111 returns the processing to step S69, drives the charging device 135 and causes the cloth 105A to adhere to the adhesion surface 136. The CPU 111 repeats the processing from step S69 to step S79 until the holding position is positioned within the permissible range. When the holding position is positioned within the permissible range, the CPU 111 moves the charging device 135 to the transfer position A, and advances the processing to step S82.

The CPU 111 operates the electromagnetic valve 118, and drives the suction valve 145 (step S82). The suction valve 145 discharges the air inside the suction box 141 to the outside, and sucks the cloth 105A on the suction surface 144 via the circulation holes 143 of the circulation plate 142. The suction mechanism 140 holds the position of the cloth 105A at the transfer position A. The CPU 111 stops the driving of the charging device 135 (step S83). The charging device 135 releases the adhesion of the cloth 105A to the adhesion surface 136. The CPU 111 drives the movement mechanism 120A and performs processing to set the movement mechanism 120A to the stand-by mode (step S84). The CPU 111 controls the driving of the arm drive motors 121A to 121D until the movement mechanism 120A enters the stand-by mode (no at step S86; step S84). When the movement mechanism 120A enters the stand-by mode (yes at step S86), the CPU 111 transmits a feed complete signal to the PC 200 (step S87). The CPU 111 returns the processing to step S41, and stands by to receive various command signals from the PC 200.

As shown in FIG. 19, when the CPU 51 of the sewing machine 1A receives an acceptance preparation complete signal (yes at step S129), the CPU 51 drives the X-axis movement mechanism and the Y-axis movement mechanism of the horizontal movement mechanism 6 and moves the holding body 70 to a transfer position A (step S131). The "transfer position" is a position to the right of the needle plate 12 and at which the holding body 70 can hold the cloth 105, when the presser plate 74 is in the front position. After the holding body 70 has moved, the CPU 51 returns the processing to step S121, and stands by to receive various command signals from the PC 200.

Figure 14:
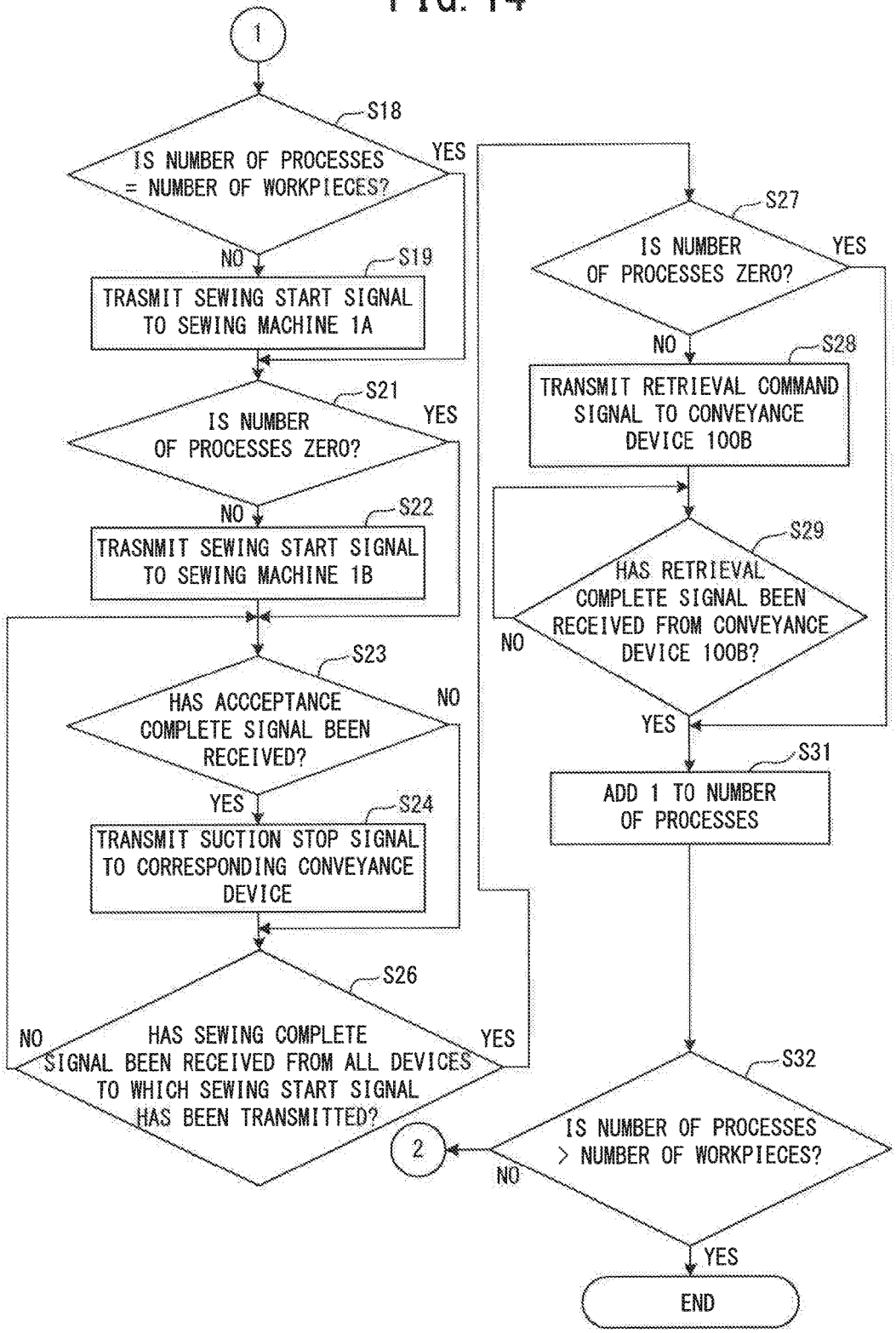
FIG. 14 is a flowchart continuing from FIG. 13.

As shown in FIG. 13, in the processing at step S13, when the number of processes is not zero, the CPU 201 of the PC 200 advances the processing to step S14 (no at step S13), and when the number of processes is zero, the CPU 201 advances the processing to step S17 (yes at step S13). When the number of processes in the processing at step S13 is zero, the CPU 201 stands by (no at step S17) until it has received the feed complete signal from all of the conveyance devices 100 to which the CPU 201 has transmitted the feed start signal. When the CPU 201 receives the feed complete signal from the conveyance device 100A (yes at step S17), the CPU 201 advances the processing to step S18. As shown in FIG. 14, when the number of processes and the number of workpieces are different from each other, the CPU 201 advances the processing to step S19 (no at step S18), and when the number of processes and the number of workpieces are the same, the CPU 201 advances the processing to step S21 (yes at step S18). In the processing at step S18, when the number of processes is zero, the CPU 201 transmits a sewing start signal to the sewing machine 1A (step S19), and advances the processing to step S21.

Figure 20:
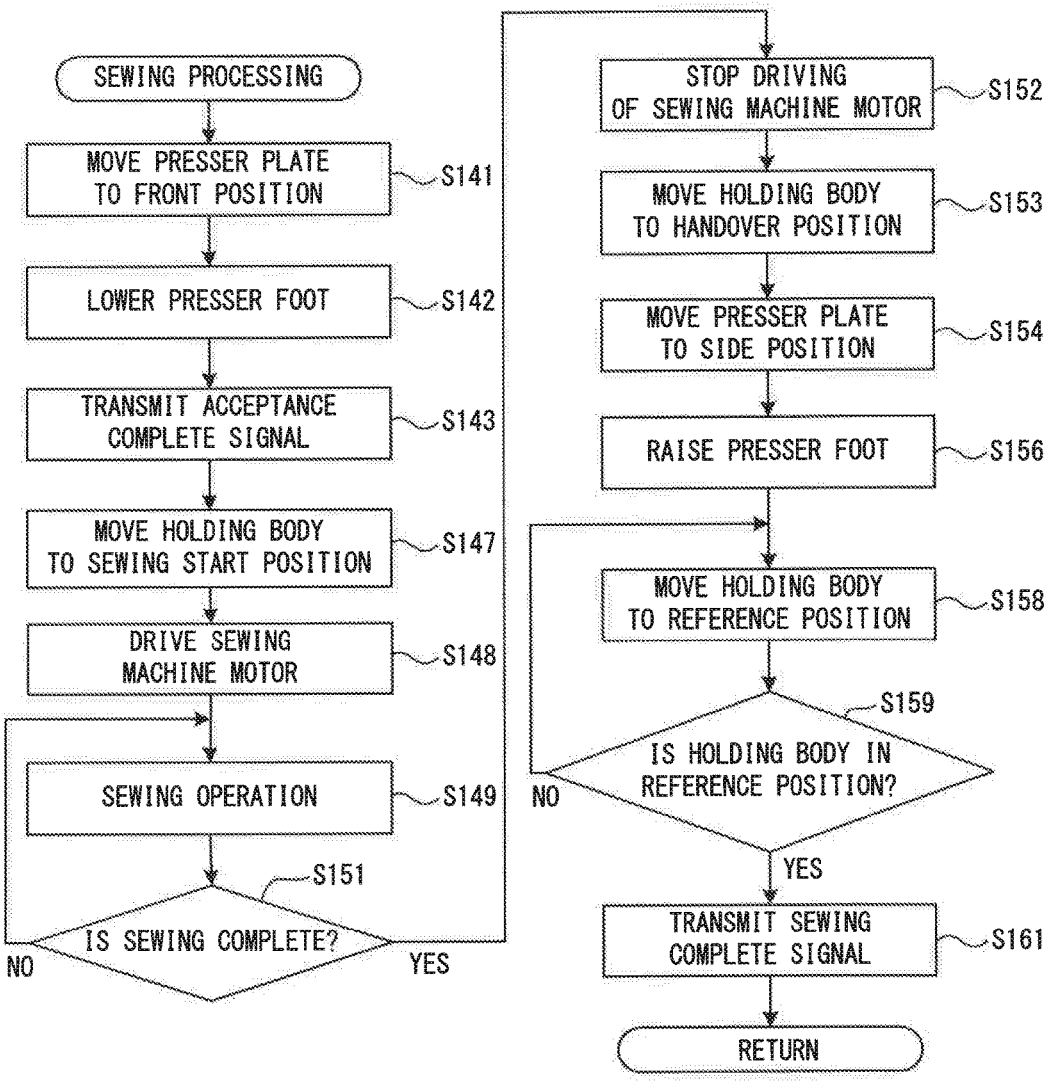
FIG. 20 is a flowchart of sewing processing.

As shown in FIG. 19, when the CPU 51 of the sewing machine 1A receives the sewing start signal (yes at step S132), the CPU 51 executes the sewing processing (step S133). As shown in FIG. 20, the CPU 51 operates the electromagnetic valve 39 and drives the air cylinder 72, and moves the presser foot 73 to the right with respect to the raising/lowering plate 71. The presser plate 74 moves to the front position (step S141). The CPU 51 operates the electromagnetic valve 38, and drives the air cylinder 69, and lowers the presser foot 73 with respect to the presser arm 65, via the raising/lowering lever (step S142). The presser plate 74 is lowered at the transfer position A, and the cloth 105A is clasped between the presser plate 74 and the accessory plate 5 and thus held. The CPU 51 transmits an acceptance complete signal to the PC 200 (step S143).

The CPU 51 drives the X-axis movement mechanism and the Y-axis movement mechanism of the horizontal movement mechanism 6 and performs processing to move the holding body 70 to the sewing start position (step S147). The CPU 51 drives the sewing machine motor 31 (step S148), moves the holding body 70 in accordance with the sewing data, and performs the sewing on the cloth 105A (step S149). Specifically, the CPU 51 controls the up-and-down movement of the needle bar 10 and driving of the perpendicular shuttle, by driving the sewing machine motor 31 and driving the drive shaft to rotate. The CPU 51 conveys, in synchronization with the driven rotation of the drive shaft, a rotation direction and pulses of a number of drive pulses indicated by the sewing data to the X-axis motor 32 and the Y-axis motor 34. The CPU 51 sequentially moves the holding body 70 to positions corresponding to the needle drop points, and continues a sewing operation to form stitches on the cloth 105A (no at step S151; step S149).

When the stitches based on the sewing data are formed and the sewing is complete (yes at step S151), the CPU 51 stops the driving of the sewing machine motor 31 (step S152). The CPU 51 drives the X-axis movement mechanism and the Y-axis movement mechanism of the horizontal movement mechanism 6, and moves the holding body 70 to a handover position A (step S153). The "handover position" is a position to the left of the needle plate 12, and at which the cloth 105A on which the sewing is complete can be handover in a "handover position" on the accessory plate 5. A "handover position A" is a position at which the conveyance device 100B accepts the cloth 105A on which the sewing is complete. When the holding body 70 is positioned at the handover position A and the presser plate 74 is in a side position A, the conveyance device 100B receives the cloth 105A. A handover position B is a position at which the cloth clamping device 150C can clamp, by the cloth clamping device 150C, the cloth 105C on which the sewing by the sewing machine 1B is complete.

The CPU 51 operates the electromagnetic valve 39 and drives the air cylinder 72, and moves the presser foot 73 to the left relative to the raising/lowering plate 71. The presser plate 74 moves to the side position A (step S154). The cloth 105A held by the presser plate 74 moves to the handover position A, along with the presser plate 74. The CPU 51 operates the electromagnetic valve 38 and drives the air cylinder 69, and raises the presser foot 73 via the raising/lowering lever (step S156). The presser plate 74 separates from the cloth 105A.

The CPU 51 drives the X-axis movement mechanism and the Y-axis movement mechanism of the horizontal movement mechanism 6, and moves the holding body 70 to a reference position A (step S158). The reference position is a position of the holding body 70 that is set in advance based on the starting position. The CPU 51 controls the driving of the X-axis motor 32 and the Y-axis motor 34 until the holding body 70 has moved to the reference position A (no at step S159; step S158). When the holding body 70 moves to the reference position A (yes at step S159), the CPU 51 transmits a sewing complete signal to the PC 200 (step S161). The CPU 51 returns the processing to step S121 of the sewing control processing and stands by to receive various command signals from the PC 200.

As shown in FIG. 14, in the processing at step S21, when the number of processes is not zero, the CPU 201 of the PC 200 advances the processing to step S22 (no at step S21), and when the number of processes is zero, the CPU 201 advances the processing to step S23 (yes at step S21). When the number of processes is zero in the processing at step S21, the CPU 201 stands by to receive the acceptance complete signal and the sewing complete signal from all of the sewing machines 1 to which the CPU 201 has transmitted the sewing start signal (no at step S23; no at step S26; step S23). When the CPU 201 has received the acceptance complete signal transmitted by the sewing machine 1 before starting the sewing operation (yes at step S23), the CPU 201 transmits a suction stop signal to the conveyance device 100 corresponding to the sewing machine 1 that has transmitted the acceptance complete signal (step S24). Specifically, when the CPU 201 has received the acceptance complete signal from the sewing machine 1A, the CPU 201 transmits the suction stop signal to the conveyance device 100A, and when the CPU 201 has received the acceptance complete signal from the sewing machine 1B, the CPU 201 transmits the suction stop signal to the conveyance device 100B. The CPU 201 advances the processing to step S26.

As shown in FIG. 15, when the CPU 111 of the conveyance device 100 receives the suction stop signal (yes at step S51), the CPU 11 operates the electromagnetic valve 118 and stops the driving of the suction valve 145 (step S52). The suction mechanism 140 stops the suction with respect to the cloth 105A. Even when the suction of the suction mechanism 140 has stopped, the sewing machine 1A holds the cloth 105A by clasping the cloth 105A between the presser plate 74 and the accessory plate 5, and thus the cloth 105A is maintained in the state of being positioned in the transfer position A. The CPU 111 returns the processing to step S41, and stands by to receive various command signals from the PC 200.

As shown in FIG. 14, in the processing at step S26, when the CPU 201 of the PC 200 receives the sewing complete signal from all of the sewing machines 1 to which the CPU 201 has transmitted the sewing start signal (yes at step S26), the CPU 201 advances the processing to step S27. The CPU 201 has transmitted the sewing start signal to the sewing machine 1A when the number of processes is zero, so when the CPU 201 receives the sewing complete signal from the sewing machine 1A, the CPU 201 advances the processing to step S27. When the number of processes is not zero, the CPU 201 advances the processing to step S28 (no at step S27), and when the number of processes is zero, the CPU 201 advances the processing to step S31 (yes at step S27). When the number of processes is zero in the processing at step S27, the CPU 201 adds 1 to the number of processes (step S31). The CPU 201 determines whether or not the number of processes is larger than the number of workpieces (step S32) and, when the number of processes is equal to or less than the number of workpieces, the CPU 201 returns the processing to step S6 (no at step S32).

When the number of processes is zero, as described above, the CPU 201 controls the conveyance device 100A and uses the movement mechanism 120A to place the cloth 105A, which has been removed from the cloth box 102 by the cloth clamping device 150A, at the transfer position A. The CPU 201 controls the sewing machine 1A, accepts the cloth 105 at the transfer position A, and performs the sewing. The sewing machine 1A places the sewn cloth 105A at the handover position A. During that time, the conveyance device 100B and the sewing machine 1B stand by to perform processing.

As shown in FIG. 13, when number of processes is equal to or more than 1 and is less than the number of workpieces, the CPU 201 repeatedly executes all of the processing from step S6 to step S32. When the number of processes is not zero (no at step S6), the CPU 201 transmits a handover start signal to the conveyance device 100B (step S7). The CPU 201 stands by until it receives a handover complete signal from the conveyance device 100B (no at step S8).

Figure 17:
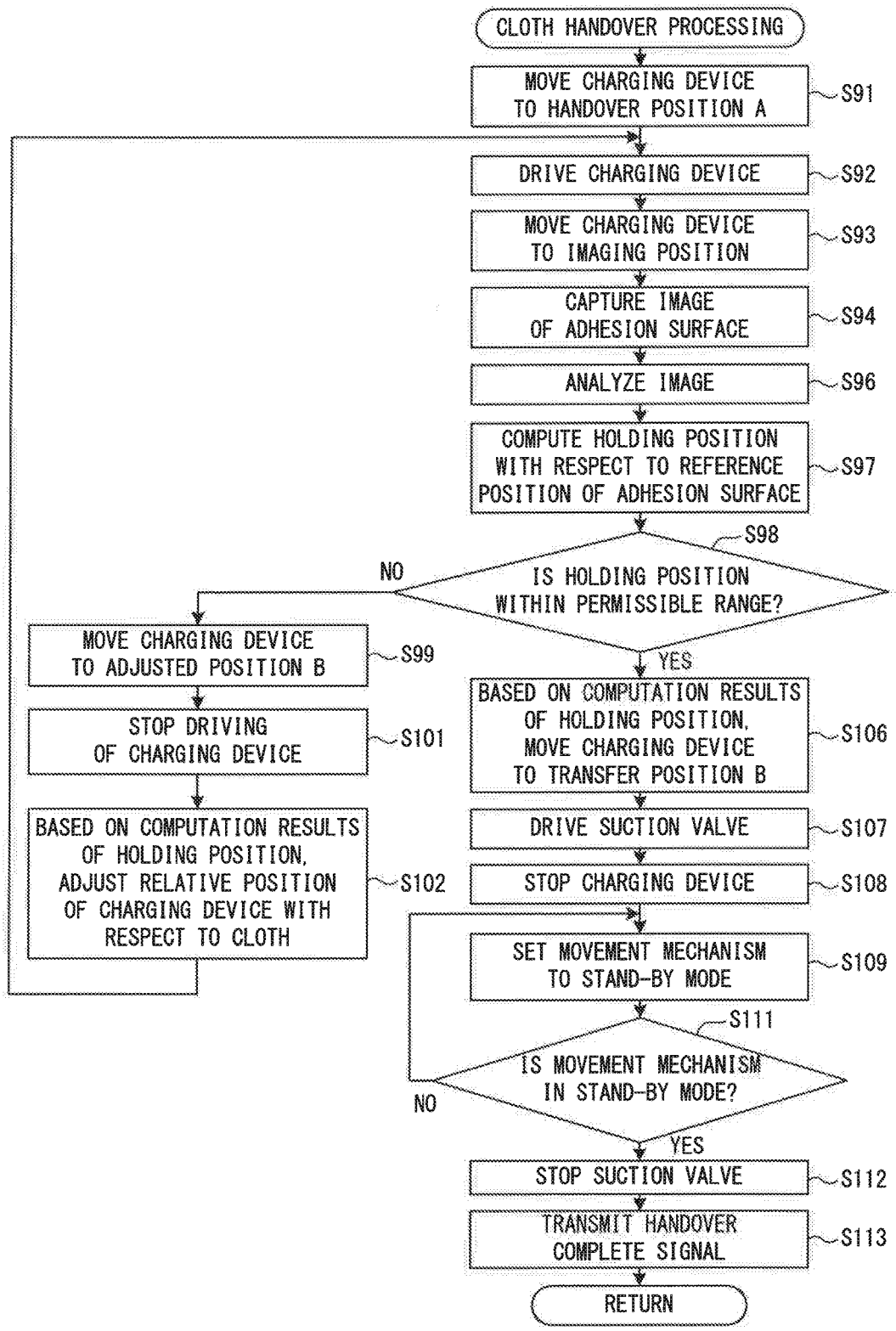
FIG. 17 is a flowchart of cloth handover processing.

As shown in FIG. 15, when the CPU 111 of the conveyance device 100B receives the handover start signal (yes at step S53), the CPU 111 executes cloth handover processing (step S54). As shown in FIG. 17, the CPU 111 drives the arm drive motors 121A to 121D of the movement mechanism 120B and moves the charging device 135 to the handover position A (step S91). The CPU 111 controls the movement mechanism 120B in accordance with a program created in advance, and moves the charging device 135 to a predetermined position of the handover position A.

Processing from step S92 to step S111 described below is substantially the same as the processing at step S69 to step S86 of the cloth feed processing, and an explanation thereof is therefore simplified. The CPU 111 drives the charging device 135 and causes the cloth 105A at the handover position A to adhere to the adhesion surface 136 (step S92). The CPU 111 moves the charging device 135 to an imaging position B (step S93). The CPU 111 uses the imaging device 117 to capture an image of the adhesion surface 136 (step S94), and analyzes the captured image (step S96). The CPU 111 computes relative position coordinates and a relative rotation angle of the holding position with respect to the reference position (step S97). When the holding position is within the permissible range (yes at step S98), based on the computation results of the holding position, the CPU 111 moves the charging device 135 to a transfer position B (step S106). When the holding position is not within the permissible range (no at step S98), the CPU 111 moves the charging device 135 to an adjusted position B (step S99). The CPU 111 stops the driving of the charging device 135 (step S101). Based on the computation results of step S97, the CPU 111 moves the charging device 135 and adjusts the relative position between the reference position and the cloth 105A in the adjusted position B (step S102).

The CPU 111 returns the processing to step S92, and uses the charging device 135 to cause the cloth 105A to adhere to the adhesion surface 136. The CPU 111 repeats the processing from step S92 to step S102 until the holding position is positioned within the permissible range. When the holding position is positioned within the permissible range, the CPU 111 moves the charging device 135 to the transfer position B, and advances the processing to step S107.

The CPU 111 drives the suction valve 145 (step S107), and determines the position of the cloth 105A at the transfer position B. The CPU 111 stops the driving of the charging device 135 (step S108), and releases the adhesion of the cloth 105A to the adhesion surface 136. The CPU 111 controls the driving of the arm drive motors 121A to 121D in order to set the movement mechanism 120B to the stand-by mode (step S109; no at step S111). When the movement mechanism 120B enters the stand-by mode (yes at step S111), the CPU 111 stops the driving of the suction valve 145 (step S112), and transmits the handover complete signal to the PC 200 (step S113). The CPU 111 returns the processing to step S41 of the conveyance control processing, and stands by to receive various command signals from the PC 200.

As shown in FIG. 13, in the processing at step S8, when the CPU 201 of the PC 200 receives the handover complete signal from the conveyance device 100B (yes at step S8), the CPU 201 advances the processing to step S9. When the number of processes and the number of workpieces are different from each other (no at step S9), the CPU 201 transmits the feed start signal to the conveyance device 100A (step S11), transmits the acceptance preparation signal to the sewing machine 1A (step S12), and advances the processing to step S13. The sewing machine 1A moves the holding body 70 to the transfer position A. The conveyance device 100A executes the cloth feed processing, removes the new cloth 105 from the cloth box 102A, and places the new cloth 105A at the transfer position A. When the processing is complete, the conveyance device 100A transmits the feed complete signal to the PC 200.

In the processing at step S13, when the number of processes is not zero (no at step S13), the CPU 201 transmits the feed start signal to the conveyance device 100B (step S14), transmits the acceptance preparation complete signal to the sewing machine 1B (step S16), and advances the processing to step S17. The sewing machine 1B moves the holding body 70 to a transfer position B. The conveyance device 100B executes the cloth feed processing, removes the cloth 105B from the cloth box 102B, and stacks the cloth 105B on top of the cloth 105A at the transfer position B. When the processing is complete, the conveyance device 100B transmits the feed complete signal to the PC 200.

When the CPU 201 receives the feed complete signal from both of the conveyance devices 100A and 100B (yes at step S17), the CPU 201 advances the processing to step S18. As shown in FIG. 14, when the number of processes and the number of workpieces are different from each other in the processing at step S18, the CPU 201 transmits the sewing start signal to the sewing machine 1A (step S19), and advances the processing to step S21. The sewing machine 1A executes the sewing processing, accepts the cloth 105A newly placed at the transfer position A by the conveyance devices 100A, and performs the sewing. When the sewing machine 1A finishes the sewing operation and places the sewn cloth 105A at the handover position A, the sewing machine 1A transmits the sewing complete signal to the PC 200.

In the processing at step S21, when the number of processes is not zero, the CPU 201 transmits the sewing start signal to the sewing machine 1B (step S22), and advances the processing to step S23. The sewing machine 1B accepts the cloths 105A and 105B that have been overlapped at the transfer position B by the conveyance device 100B, and performs the sewing. When the sewing machine 1B finishes the sewing operation and places the sewn cloth 105C at a handover position B, the sewing machine 1B transmits the sewing complete signal to the PC 200.

When the CPU 201 receives the sewing complete signal from both of the sewing machines 1A and 1B (yes at step S26), the CPU 201 advances the processing to step S27. Since the number of processes is not zero (no at step S27), the CPU 201 transmits a retrieval command signal to the conveyance device 100B (step S28). The CPU 201 stands by until it receives a retrieval complete signal from the conveyance device 100B (no at step S29).

Figure 18:
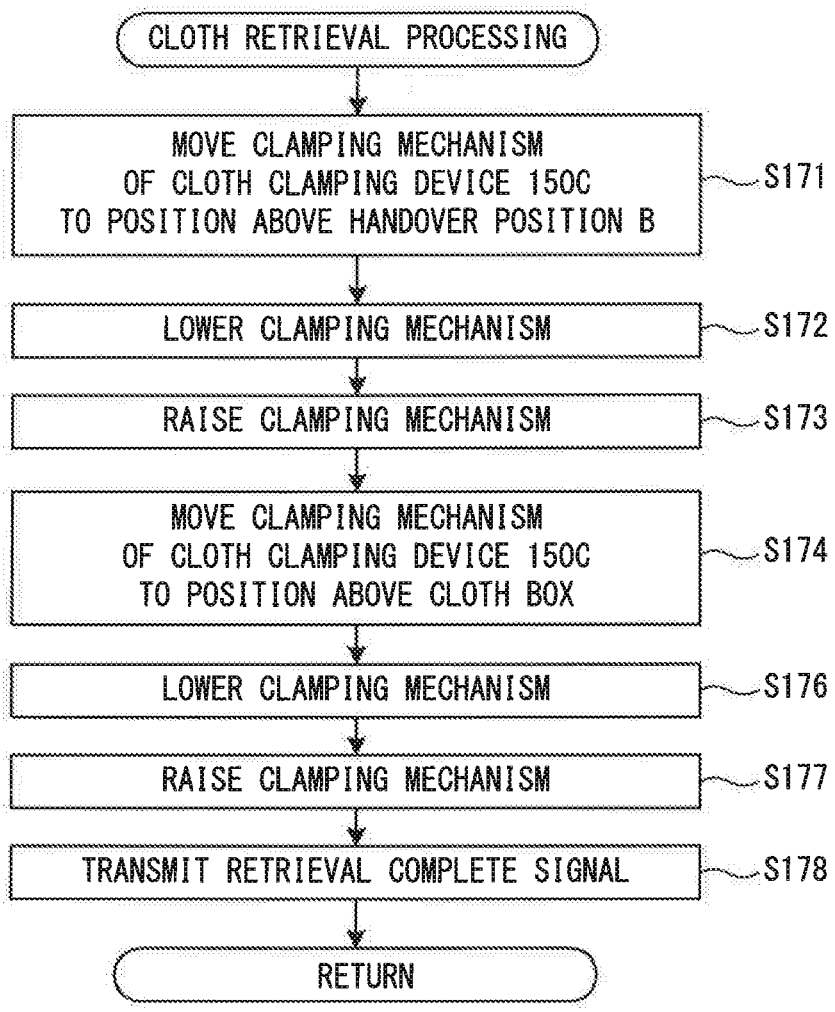
FIG. 18 is a flowchart of cloth retrieval processing.

As shown in FIG. 15, when the CPU 111 of the conveyance device 100B receives the retrieval command signal (yes at step S56), the CPU 111 executes cloth retrieval processing (step S57). As shown in FIG. 18, the CPU 111 operates the electromagnetic valve 151 and drives the air cylinder 162 of the cloth clamping device 150C, and pivots the support pillar 163 by substantially 180 degrees in the clockwise direction in a plan view. The up-and-down movement mechanism 170 and the clamping mechanism 180 moves to a position above the handover position B (step S171). The CPU 111 operates the electromagnetic valve 152 and drives the up-and-down movement mechanism 170 of the cloth clamping device 150C, and lowers the clamping mechanism 180 toward the handover position B (step S172). The foot portions 183 and the clamping portions 184 of the clamping mechanism 180 come into contact with the cloth 105C at the handover position B, and the cloth 105C is clasped between the clamping portions 184 and the foot portions 183. The CPU 111 operates the electromagnetic valve 152 and drives the up-and-down movement mechanism 170, thus raising the clamping mechanism 180 (step S173). When the leg portions 182 move to the upper position, the holding mechanism 190 operates, and the clamping mechanism 180 maintains the state of clamping the cloth 105C.

The CPU 111 operates the electromagnetic valve 151 and drives the air cylinder 162, and pivots the support pillar 163 by substantially 180 degrees in the counterclockwise direction in a plan view. The up-and-down movement mechanism 170 and the clamping mechanism 180 moves to a position above the cloth box 102C (step S174). The CPU 111 operates the electromagnetic valve 152 and drives the up-and-down movement mechanism 170, thus lowering the clamping mechanism 180 inside the cloth box 102C (step S176). Inside the cloth box 102C, when the foot portions 183 come into contact with the upper surface of the accessory plate 5 or with the cloth 105C already stored inside the cloth box 102C and the leg portions 182 are subject to the upward pressing force, the holding mechanism 190 releases the hold of the leg portions 182. The CPU 111 operates the electromagnetic valve 152 and drives the up-and-down movement mechanism 170, thus raising the clamping mechanism 180 (step S177). The cloth 105C remains inside the cloth box 102C. The CPU 111 transmits a retrieval complete signal to the PC 200 (step S178). The CPU 111 returns the processing to step S41 of the conveyance control processing, and stands by to receive various command signals from the PC 200.

As shown in FIG. 14, in the processing at step S29, when the CPU 201 of the PC 200 receives the retrieval complete signal from the conveyance device 100B (yes at step S29), the CPU 201 adds 1 to the number of processes (step S31). If the number of processes is equal to or less than the number of workpieces, the CPU 201 returns the processing to step S6 (no at step S32).

As described above, when the number of processes is 1 or more and is less than the number of workpieces, the CPU 201 controls the conveyance device 100B, and uses the movement mechanism 120B to move the cloth 105A sewn by the sewing machine 1A from the handover position A to the transfer position B. The CPU 201 controls the conveyance device 100B, uses the movement mechanism 120B to move the cloth 105B removed from the cloth box 102B by the cloth clamping device 150B to the transfer position B, and stacks the cloth 105B on top of the cloth 105A. The CPU 201 controls the sewing machine 1B, accepts the cloths 105A and 105B at the transfer position B and sews the cloths 105A and 105B together. The sewing machine 1B places the sewn cloth 105C at the handover position B. In parallel to this, the CPU 201 controls the conveyance device 100A, and uses the movement mechanism 120A to place the cloth 105A removed from the cloth box 102A by the cloth clamping device 150A at the transfer position A. The CPU 201 controls the sewing machine 1A, accepts the cloth 105A at the transfer position A, and sews the cloth 105A. The sewing machine 1A places the sewn cloth 105A at the handover position A. The CPU 201 controls the conveyance device 100B, and stores the cloth 105C sewn by the sewing machine 1B in the cloth box 102C, using the cloth clamping device 150C.

As shown in FIG. 13, the CPU 201 repeats the processing from step S6 to step S32, and when the number of processes becomes the same as the number of workpieces, the CPU 201 executes the processing while omitting the processing at step S11, step S12, and step S19. In the processing at step S7, the CPU 201 transmits the handover start signal to the conveyance device 100B. The conveyance device 100B moves the cloth 105A placed at the handover position A by the sewing machine 1A to the transfer position B, and transmits the handover complete signal to the PC 200. The CPU 201 transmits the feed start signal to the conveyance device 100B in the processing at step S14, and transmits the acceptance preparation signal to the sewing machine 1B in the processing at step S16. The sewing machine 1B moves the holding body 70 to the transfer position B. The conveyance device 100B stacks the cloth 105B on top of the cloth 105A at the transfer position B. After the stacking, the conveyance device 100B transmits the feed complete signal to the PC 200.

In the processing at step S22, the CPU 201 transmits the sewing start signal to the sewing machine 1B. The sewing machine 1B accepts the cloths 105A and 105B at the transfer position B and sews the cloths 105A and 105B. After the sewing, the sewing machine 1B places the cloth 105C at the handover position B, and transmits the sewing complete signal to the PC 200. In the processing at step S28, the CPU 201 transmits the retrieval command signal to the conveyance device 100B. The conveyance device 100B stores the cloth 105C in the cloth box 102C using the cloth clamping device 150C, and transmits the retrieval complete signal to the PC 200. During this time, the conveyance device 100A and the sewing machine 1A stand by for processing. In the processing at step S31, the CPU 201 adds 1 to the number of processes. The number of processes becomes larger than the number of workpieces (yes at step S32). The CPU 201 ends the execution of the system control processing.

As described above, when the clamping mechanism 180 is lowered, the foot portion 183 and the leading end portion 188 of the clamping portion 184 come into contact with the cloth 105. When the clamping mechanism 180 is lowered further, the leg portion 182 moves from the lower position to the upper position, and the clamping portion 184 pivots from the open position toward the closed position. The section of the clamping portion 184 in contact with the cloth 105 moves to the curved surface 186, and applies a stable pressing force to the cloth 105. Thus, it is possible to draw up the single cloth 105. The leading end portion 188 of the clamping portion 184 moves to the position above the foot portion 183, and the cloth 105 is clamped between the curved surface 186 and the upper surface of the foot portion 183. As a result, the cloth clamping device 150 can reliably separate the single cloth 105 from among the plurality of cloths 105 stacked on top of each other, with the simple configuration using the leg portion 182 that moves up and down and the clamping portion 184 that pivots.

Due to the urging of the compression spring 179, the leg portion 182 can reliably press the cloth 105 downward. Due to the urging of the torsion spring 175, the clamping portion 184 can apply the more stable pressing force to the cloth 105 from the curved surface 186, and can thus reliably draw up the cloth 105. As a result, the cloth clamping device 150 can reliably separate the single cloth 105 from among the plurality of cloths 105 stacked on top of each other.

When the clamping mechanism 180 clamps the cloth 105, the leg portion 182 is positioned in the upper position, and the clamping portion 184 is positioned in the closed position. When the holding mechanism 190 holds the leg portion 182 in the upper position, the foot portion 183 comes into contact with the leading end portion 188 of the clamping portion 184, and maintains the clamping portion 184 in the closed position. Thus, even when the up-and-down movement mechanism 170 moves the clamping mechanism 180 upward, the clamping mechanism 180 can maintain the state of clamping the cloth 105.

Due to its mechanical configuration, the holding mechanism 190 can switch between the state in which the leg portion 182 can move up and down and the state in which the leg portion 182 is held in the upper position, each time the leg portion 182 moves up-and-down once with respect to the support portion 181. When the up-and-down movement mechanism 170 moves the clamping mechanism 180 up and down, the leg portion 182 rises when the support portion 181 is lowered, and the leg portion 182 lowers when the support portion 181 is raised, in the state in which the foot portion 183 is in contact with the cloth 105. Specifically, the holding mechanism 190 mechanically moves in concert with the up and down movement of the clamping mechanism 180 by the up-and-down movement mechanism 170, and can switch between the holding of the leg portion 182 and the up and down movement of the leg portion 182. As a result, in the cloth clamping device 150, it is not necessary to provide a separate driving source for the operation of the holding mechanism 190, and the configuration can be simplified. Costs can thus be reduced.

The holding mechanism 190 operates as a result of the engagement of the pin 192 with the groove-shaped guide portion 194, the restricting portion 195 and the groove portion 198, and can reliably switch between the state in which the leg portion 182 can move up and down and the state in which the leg portion 182 is held in the upper position.

The long hole 154 of the foot portion 183 and the screw 153 can adjust the gap between the foot portion 183 and the leading end portion 188 of the clamping portion 184, in accordance with the thickness, the material and so on of the cloth 105. As a result, the clamping mechanism 180 can reliably separate the single cloth 105 from among the plurality of cloths 105 stacked on top of each other. A gap between the foot portion 183 and the leading end portion 188 of the clamping portion 184 can be easily adjusted only moving the foot portion 183 with respect to the screws 153 in the range of the long holes 154.

Due to the pad 176, the clamping portion 184 does not easily slip with respect to the cloth 105, and thus, the clamping mechanism 180 can reliably separate the single cloth 105 from among the plurality of cloths 105 stacked on top of each other.

The frictional force of the pad 103 is smaller than the frictional force of the pad 176, and thus, when the clamping portion 184 clamps the last single cloth 105 from the cloth box 102, the pad 176 can draw up the cloth 105 in resistance to the pad 103. As a result, the clamping mechanism 180 can reliably clamp the last single cloth 105.

The clamping mechanism 180 can perform the clamping in a plurality of locations on the cloth 105, using a plurality of pairs of the clamping portions 184 and the foot portions 183. As a result, the clamping mechanism 180 can reliably separate the single cloth 105 from among the plurality of cloths 105 stacked on top of each other.

In addition to the above-described embodiment, various modifications can be made to the present disclosure. The conveyance system 300 may be provided with one each of the sewing machine 1 and the conveyance device 100, or may be provided with three or more of each of the devices. When the conveyance system 300 is provided with the plurality of the sewing machines 1 and the conveyance devices 100, not all the sewing machines 1 and the conveyance devices 100 need necessarily perform each of the processes of the sewing operation, and the power source may be switched off to some of the sewing machines 1 and the conveyance devices 100. The pivoting mechanism 160 and the up-and-down movement mechanism 170 of the cloth clamping device 150 may be driven by a motor, an actuator or the like as a power source. The up-and-down movement of the holding body 70, and the left-and-right movement of the presser plate 74 is not limited to being driven by the air cylinders, and may be driven by a motor, an actuator or the like as a power source.

In the holding mechanism 190, the upper end of the support rod 191 may be pivotally supported by the upper portion of the support portion 181, and the switching member 197 may be fixed to the upper surface of the foot portion 183. In this case also, the holding mechanism 190 can switch between the state in which the leg portion 182 can move up and down and the state in which the leg portion 182 is held in the upper position, each time the leg portion 182 moves up-and-down once with respect to the support portion 181.

The clamping portion 184 may move from the closed position to the open position as a result of its own weight without the torsion spring 175. When the pin 192 engages with the guide portion 194, the leg portion 182 may move from the upper position to the lower position as a result of its own weight without the compression spring 179.

The clamping portion 184 may be a roller-shaped member, for example. A configuration may be adopted in which, when the clamping mechanism 180 is lowered over the cloth 105 and the roller-shaped member comes into contact with the cloth 105, the roller-shaped member pivots and causes the cloth 105 to bend, and the bent section of the cloth 105 is clasped and clamped between the foot portion 183 and the roller-shaped member. In this case, the roller-shaped member may be coupled to the leg portion 182 by a gear or the like, and, when the leg portion 182 moves from the lower position to the upper position, the roller-shaped member may rotate in accordance with the movement of the leg portion 182.

The gap between the foot portion 183 and the clamping portion 184 may be adjusted by attaching a foot portion of a different size that protrudes to the side from the leg portion 182. A support hole in the support portion 181 that supports the shaft rod 185, which is the rotational center of the clamping portion 184, may have a long hole shape. In this case, the support portion 181 may adjust the gap between the foot portion 183 and the clamping portion 184 by supporting the clamping portion 184 to be close to or separated from the leg portion 182. The support hole in the support portion 181 that supports the shaft rod 185, which is the rotational center of the clamping portion 184, may be provided in a plurality. In this case, the support portion 181 may adjust the gap between the foot portion 183 and the clamping portion 184 by supporting the clamping portion 184 to be close to or separated from the leg portion 182, by selecting the support hole for the shaft rod 185.

A plurality of protrusions may be provided on the clamping portion 184, from the surface of the leading end portion 188 over the curved surface 186, and the cloth 105 may be caused to hook onto the protrusions, thus securing the frictional force with respect to the cloth 105. The clamping portion 184 may have a substantially elliptical shape in a side view, with a curved surface. The clamping portion 184 need not necessarily have the curved surface 186 which is curved downward between the leading end portion 188 and the base end portion 189, and may have a substantially flat surface.

Figure 31:
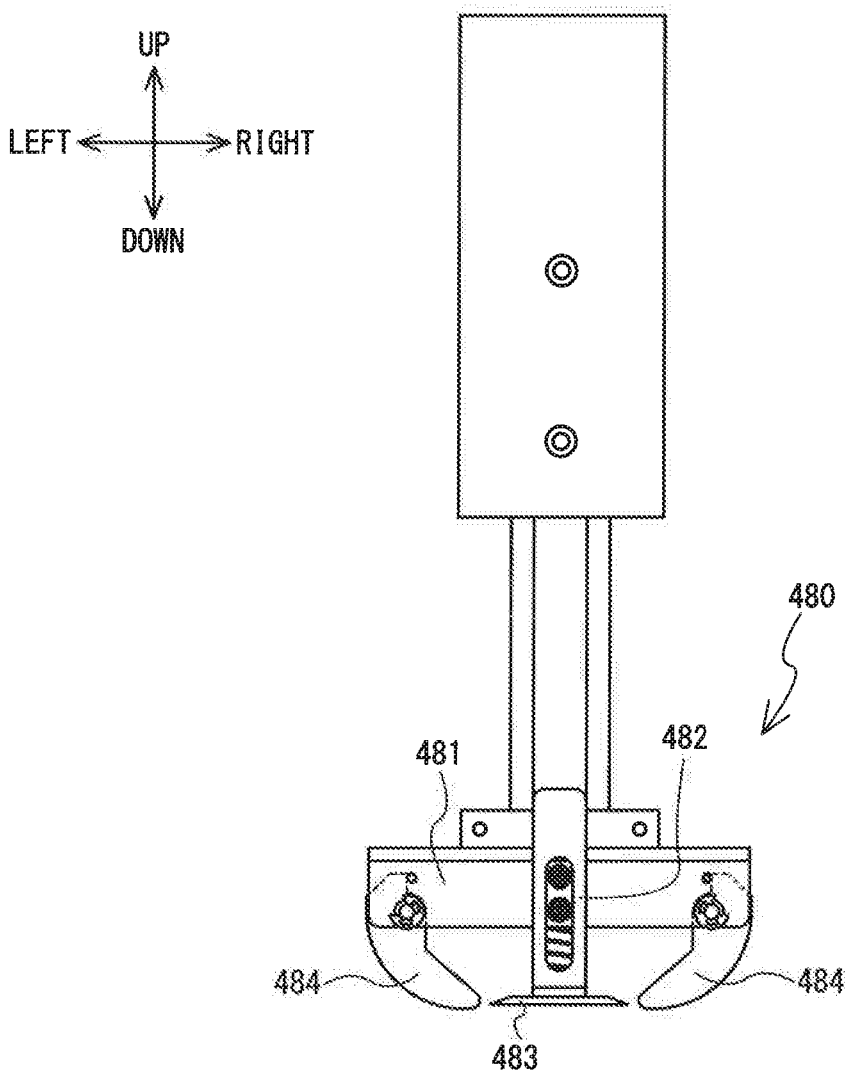
FIG. 31 is a front view of a clamping mechanism 480.

There may be one pair of the leg portions 182 and the clamping portions 184, or there may be three or more pairs. As shown in FIG. 31, a clamping mechanism 480 may be provided with two clamping portions 484 with respect to a single leg portion 482. The leg portion 482 is provided in a center, in the left-right direction, of a support portion 481, and the clamping portions 484 are supported on both of left and right ends of the support portion 481. A foot portion 483 is provided on a bottom portion of the leg portion 482, and the foot portion 483 protrudes to both sides on the left and the right. The foot portion 483 protrudes to the side of the clamping portions 484 on both the left and the right. The clamping mechanism 480 can clamp the cloth 105 in two locations using the two clamping portions 484 and the single leg portion 482. The clamping mechanism 480 may be provided with a holding mechanism that can hold the leg portion 482 in the upper position, when the leg portion 482 has moved from the lower position to the upper position. The holding mechanism may have the same configuration as that of the holding mechanism 190.

What is claimed is:

1. A cloth clamping device comprising:

a clamping mechanism configured to come into contact with an upper surface of a cloth, among cloths placed so as to be stacked in the up-down direction, and to clamp the cloth with which the contact is made, the clamping mechanism including a support portion, a leg portion, a foot portion, and a clamping portion, the leg portion being provided on the support portion such that a lower end of the leg portion protrudes below the support portion, and such that the leg portion is capable of moving up and down between an upper position in which the leg portion is positioned relatively upward with respect to the support portion, and a lower position in which the leg portion is positioned relatively downward with respect to the support portion, the foot portion being provided on the lower end of the leg portion and protruding in a sideway direction from the leg portion, and coming into contact with the upper surface of the cloth when the leg portion is positioned in the upper position, the clamping portion including a leading end portion and a base end portion, the leading end portion facing the foot portion in the sideway direction, and the base end portion being pivotally supported by the support portion, at a position in the sideway direction with respect to the leading end portion and above the leading end portion, and the clamping portion being positioned in a closed position when the leg portion is in the upper position and being positioned in an open position when the leg portion is in the lower position, the closed position being a position in which the clamping portion comes into contact with the upper surface of the cloth and the leading end portion is positioned above the foot portion, and the open position being a position in which the leading end portion pivots downward with respect to the closed position and is positioned in a sideway direction with respect to the foot portion; and an up-and-down movement mechanism configured to move the clamping mechanism up and down, the up-and-down movement mechanism being connected to the support portion.

2. The cloth clamping device according to claim 1, wherein the clamping mechanism includes a holding mechanism configured to hold the leg portion in the upper position when the leg portion has moved to the upper position.

3. The cloth clamping device according to claim 2, wherein the holding mechanism includes a protruding member, a cam member, and a switching member, the protruding member is provided on the support portion, the cam member has a groove-shaped guide portion and a restricting portion, the guide portion engaging with the protruding member and guiding a relative up and down movement of the protruding member with respect to the leg portion over a movement range of the leg portion between the upper position and the lower position, and the restricting portion holding the leg portion in the upper position and restricting the relative up and down movement of the protruding member with respect to the leg portion, the switching member is provided on the leg portion, and the switching member operates in concert with the cam member and alternatingly switches a section at which the protruding member engages with the cam member between the guide portion and the restricting portion, each time the leg portion moves up-and-down once with respect to the support portion.

4. The cloth clamping device according to claim 3, wherein the protruding member is a pin provided on a lower end portion of a support rod that is provided on the support portion and that extends in the up-down direction, the support rod is provided with a cam urging member configured to urge the cam member downward, the cam member is a cylindrical rotating element capable of rotating around the support rod as a shaft, and is provided with a plurality of the groove-shaped guide portions, which extend upward from a lower end of the cam member, a plurality of the restricting portions disposed alternatingly in a circumferential direction, and first inclined surfaces, which incline in the up-down direction, are formed on portions of a peripheral wall between each of the guide portions and the restricting portions, a length in the up-down direction of a groove of the restricting portion is smaller than a length in the up-down direction of a groove of the guide portion, the switching member has a cylindrical shape and is provided on a lower end of the leg portion, coaxially with the cam member, and faces the cam member in the up-down direction, the switching member is provided with a plurality of groove portions, which extend downward from an upper end of the switching member and are disposed in the circumferential direction, and second inclined surfaces, each of which inclines in a direction intersecting the first inclined surface, are provided on portions of a peripheral wall between each of the plurality of groove portions, a length in the horizontal direction of the first inclined surface is larger than a width of the guide portion and a width of the restricting portion, a length in the horizontal direction of the second inclined surface is larger than a width of the groove portion, when the leg portion moves from the lower position to the upper position, the cam member moves relatively upward with respect to the pin, via the switching member, and the pin moves from an upper end to a lower end of one of the guide portion and the restricting portion, moves along the second inclined surface while rotating relative to the switching member, and moves into the groove portion, and when the leg portion moves from the upper position toward the lower position, the cam member moves relatively downward with respect to the pin as a result of an urging force of the cam urging member, and the pin moves from a lower end to an upper end of the groove portion, moves along the first inclined surface while rotating relative to the cam member, and moves to one of the restricting portion and the guide portion.

5. The cloth clamping device according to claim 1, further comprising:

an adjustment mechanism configured to adjust a gap between the foot portion and the leading end portion of the clamping portion.

6. The cloth clamping device according to claim 5, wherein the adjustment mechanism includes a long hole and a screw, the long hole is opened on the foot portion and extends in the protruding direction of the foot portion, and the screw is inserted into the long hole and fixes the foot portion to a bottom portion of the leg portion, and the foot portion is capable of moving with respect to the screw in a range of the long hole.

7. The cloth clamping device according to claim 1, wherein the clamping portion includes a curved surface curving downward between the leading end portion and the base end portion.

8. The cloth clamping device according to claim 1, wherein the clamping portion includes a grip portion provided from a surface of the leading end portion over the curved surface of the clamping portion, the grip portion has a larger frictional force with respect to the cloth than a frictional force between the cloths.

9. The cloth clamping device according to claim 8, wherein the frictional force of the grip portion is larger than a frictional force of a suppressing member, which is provided on a surface of a placement portion in which a plurality of the cloths are stacked and placed, and which is configured to suppress slipping between the placement portion and the cloth.

10. The cloth clamping device according to claim 1, wherein pairs of the clamping portion and the foot portion are provided in a plurality of pairs.

* * * * *